US009852566B2

(12) United States Patent
Menzi

(10) Patent No.: US 9,852,566 B2
(45) Date of Patent: Dec. 26, 2017

(54) DEVICES AND METHODS FOR LOCKING AND UNLOCKING MECHANICAL EQUIPMENT

(71) Applicant: Manfred Menzi, Baar (CH)

(72) Inventor: Manfred Menzi, Baar (CH)

(73) Assignee: Innovative Orthopedic Technologies, IOT, AG (CH)

( * ) Notice: Subject to any disclaimer, the term of this patent is extended or adjusted under 35 U.S.C. 154(b) by 0 days.

(21) Appl. No.: 14/858,775

(22) Filed: Sep. 18, 2015

(65) Prior Publication Data

US 2016/0086407 A1 Mar. 24, 2016

Related U.S. Application Data

(60) Provisional application No. 62/052,364, filed on Sep. 18, 2014.

(51) Int. Cl.
*G07C 9/00* (2006.01)

(52) U.S. Cl.
CPC ..... *G07C 9/00896* (2013.01); *G07C 2009/00507* (2013.01); *G07C 2209/08* (2013.01)

(58) Field of Classification Search
CPC ..... G07C 9/00896; G07C 2009/00507; G07C 2209/08
USPC ..... 340/5.6
See application file for complete search history.

(56) References Cited

U.S. PATENT DOCUMENTS

| | | | | |
|---|---|---|---|---|
| 2,693,796 | A * | 11/1954 | Warner | A61H 1/0222 601/98 |
| 4,509,347 | A * | 4/1985 | Young | E05B 47/0002 292/140 |
| 5,791,179 | A * | 8/1998 | Brask | E05B 13/004 292/142 |
| 6,967,562 | B2 | 11/2005 | Menard et al. | |
| 8,196,939 | B2 | 6/2012 | Bustle et al. | |
| 8,544,646 | B2 | 10/2013 | Bouhraoua et al. | |
| 8,810,361 | B2 | 8/2014 | Thukral et al. | |
| 2004/0051368 | A1* | 3/2004 | Caputo | A61M 5/142 299/1.9 |
| 2007/0083111 | A1* | 4/2007 | Hossack | A61B 1/00059 600/437 |
| 2009/0043253 | A1* | 2/2009 | Podaima | G06F 19/322 604/67 |

(Continued)

FOREIGN PATENT DOCUMENTS

WO 2010117918 A1 10/2010

*Primary Examiner* — Edwin Holloway, III
(74) *Attorney, Agent, or Firm* — Conley Rose, P.C.

(57) ABSTRACT

An electronic locking device for selectively locking a medical device includes an antenna configured to wirelessly receive information from an identification tag, wherein the identification tag comprises unlocked duration period data, a motor coupled to the antenna, and a locking pin coupled to the motor, wherein the motor is configured to transition the locking pin from a locked position to an unlocked position for a predetermined period of time prescribed by the unlocked duration period data in response to an unlocking signal received by the antenna from the identification tag, wherein the locking pin is configured to prevent usage of the medical device in the locked position and allow usage of the medical device in the unlocked position.

21 Claims, 19 Drawing Sheets

(56) References Cited

U.S. PATENT DOCUMENTS

| | | | | |
|---|---|---|---|---|
| 2014/0145822 | A1 | 5/2014 | Shoenfeld | |
| 2015/0190265 | A1* | 7/2015 | Kreuzer | A61F 5/048 602/33 |

* cited by examiner

DEVICES AND METHODS FOR LOCKING AND UNLOCKING MECHANICAL EQUIPMENT

CROSS-REFERENCE TO RELATED APPLICATIONS

This application claims benefit of U.S. provisional patent application Ser. No. 62/052,364 filed Sep. 18, 2014, and entitled "Devices and Methods for Locking and Unlocking Mechanical Equipment," which is hereby incorporated herein by reference in its entirety.

STATEMENT REGARDING FEDERALLY SPONSORED RESEARCH OR DEVELOPMENT

Not applicable.

BACKGROUND

This disclosure relates generally to devices and methods for locking and unlocking mechanical equipment and devices. More specifically, this disclosure relates to devices and methods for locking and unlocking unpowered medical equipment.

It is common in the medical field for hospitals to rent medical equipment for periods of time in order to avoid the cost of purchasing the equipment. In this manner, the medical device may be rented only when needed for performing medical operations. For example, it is common for medical devices to be rented for fixed intervals of time, such as from month-to-month or other common rental periods.

SUMMARY

An embodiment of an electronic locking device for selectively locking a medical device comprises an antenna configured to wirelessly receive information from an identification tag, wherein the identification tag comprises unlocked duration period data, a motor coupled to the antenna, and a locking pin coupled to the motor, wherein the motor is configured to transition the locking pin from a locked position to an unlocked position for a predetermined period of time prescribed by the unlocked duration period data in response to an unlocking signal received by the antenna from the identification tag, wherein the locking pin is configured to prevent usage of the medical device in the locked position and allow usage of the medical device in the unlocked position. In an embodiment, the identification tag comprises initial count data prescribing the number of times the identification tag can instruct the electronic locking device to move the locking pin from the locked position to the unlocked position in response to the unlocking signal from the identification tag. In an embodiment, the electronic locking device further comprises a digital display coupled to an integrated circuit, wherein the digital display is configured to visually indicate the unlocked duration period data. In an embodiment, the digital display is configured to visually indicate initial count data prescribing the number of times the identification tag can instruct the electronic locking device to move the locking pin from the locked position to the unlocked position in response to the unlocking signal from the identification tag. In some embodiments, the identification tag comprises a passive radio-frequency identification tag. In some embodiments, the motor is configured to retract the locking pin into the unlocked position in response to the locking pin engaging an obstruction while moving towards the locked position from the unlocked position.

An embodiment of a medical device for performing a surgical or diagnostic procedure on a patient, the medical device comprising a base, a locking member moveably coupled to the base, and an electronic locking device coupled to the base, the electronic locking device comprising an antenna configured to wirelessly receive information from an identification tag, wherein the identification tag comprises unlocked duration period data, a motor coupled to the antenna, and a locking pin coupled to the motor, wherein the motor is configured to transition the locking pin from a first position to a second position for a predetermined period of time prescribed by the unlocked duration period data in response to an unlocking signal received by the antenna from the identification tag, wherein the locking pin is configured to restrict relative movement between the locking member and the base in the first position and allow relative movement between the locking member and the base in the second position. In an embodiment, the identification tag comprises initial count data prescribing the number of times the identification tag can instruct the electronic locking device to move the locking pin from the first position to the second position in response to the unlocking signal from the identification tag. In an embodiment, the locking member is pivotally coupled to the base, and comprises a locked position configured to prevent usage of the medical device and an unlocked position configured to allow usage of the medical device. In some embodiments, when the locking pin is in the first position, the locking pin is configured to lock the locking member in the locked position. In an embodiment, when the locking pin is in the first position and the locking member is in the locked position, the locking pin is received in a groove of the locking member. In an embodiment, when the locking member is in the locked position, the locking member is configured to restrict the rotation of a crank coupled to the base. In some embodiments, the motor is configured to retract the locking pin into the second position in response to the locking pin engaging an obstruction while moving towards the first position from the second position. In some embodiments, the motor is configured to extend the locking pin towards the first position following a predetermined period of time after the refraction of the locking pin into the second position.

An embodiment of a method for controllably locking a medical device using an electronic locking device comprises preventing use of the medical device with the electronic locking device coupled to the medical device, wirelessly communicating an unlocking signal from an identification tag to the electronic locking device coupled to the medical device, wirelessly communicating unlocked duration period data from the identification tag to the electronic locking device, unlocking the electronic locking device in response to receiving the unlocking signal from the identification tag to allow free use of the medical device, and locking the electronic locking device to prevent use of the medical device after a predetermined period of time prescribed by the unlocked duration period data. In an embodiment, the method further comprises programming the identification tag with unlocked duration period data. In an embodiment, communicating information from the identification tag to the electronic locking device comprises wirelessly transmitting a radio-frequency identification signal from the identification tag to the electronic locking device. In an embodiment, the method further comprises wirelessly communicating to the electronic locking device from the identification tag initial count data prescribing the number of times the identification tag can communicate the unlocking signal to the electronic locking device to unlock the electronic locking device. In some embodiments, the method further comprises visually displaying the unlocked duration period data on a digital display of the electronic locking device. In some embodiments, unlocking the electronic locking device in response to receiving the unlocking signal from the identification tag comprises allowing a locking member coupled to a base of the medical device to move relative to the base.

BRIEF DESCRIPTION OF THE DRAWINGS

For a detailed description of the disclosed embodiments of the disclosure, reference will now be made to the accompanying drawings in which:

FIG. 2G is a bottom view of the locking device of FIG. 2A;

DETAILED DESCRIPTION OF THE DISCLOSED EMBODIMENTS

Figure 1A:
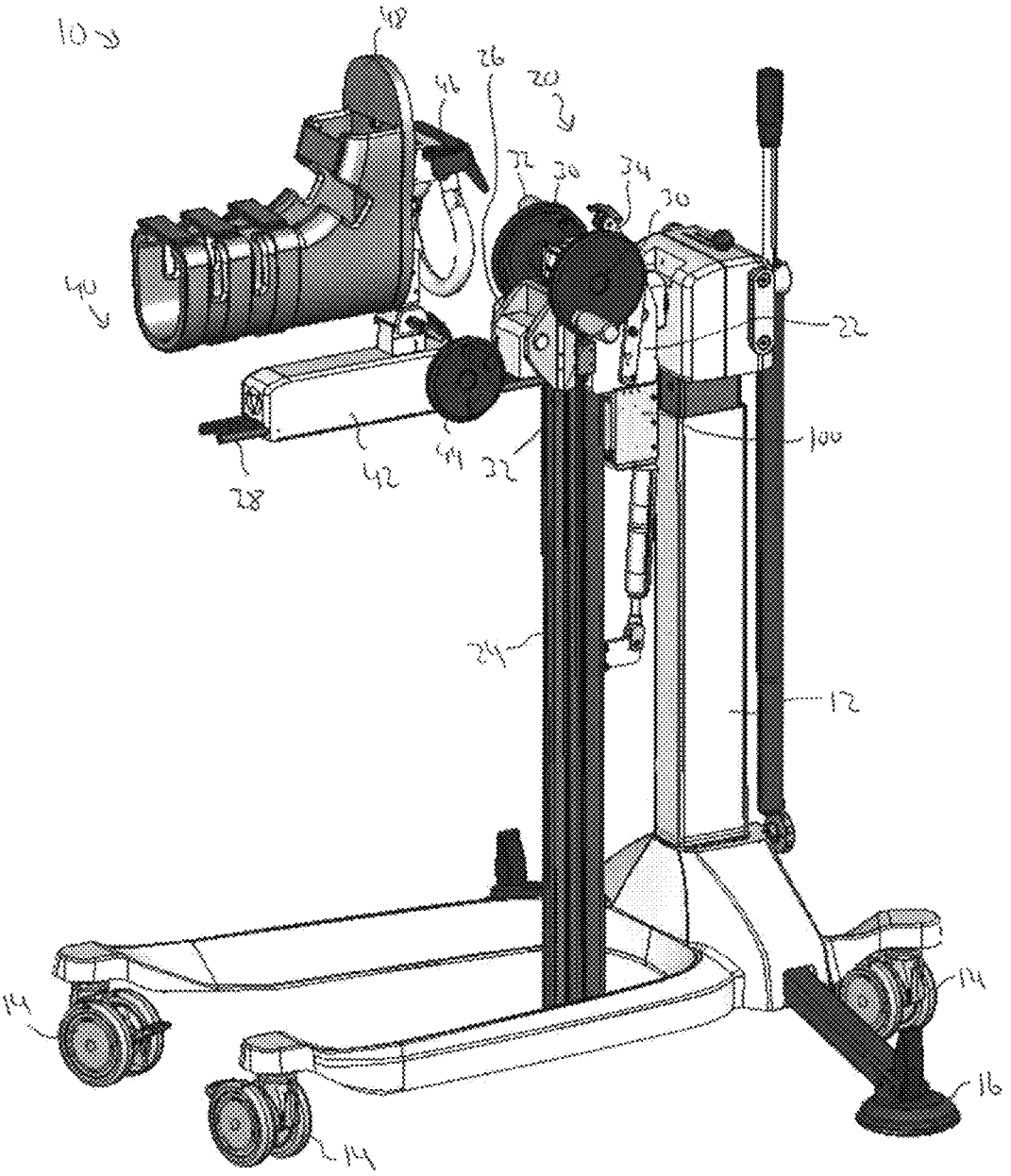
FIG. 1A is a first perspective view of a medical device including an embodiment of a locking device in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Further, as used herein, the terms "bed" and "table" refer to a patient's bed, operating table, examination bed, or any other bed used for medical procedures, operations, care, diagnostics, or combinations thereof.

Figure 1B:
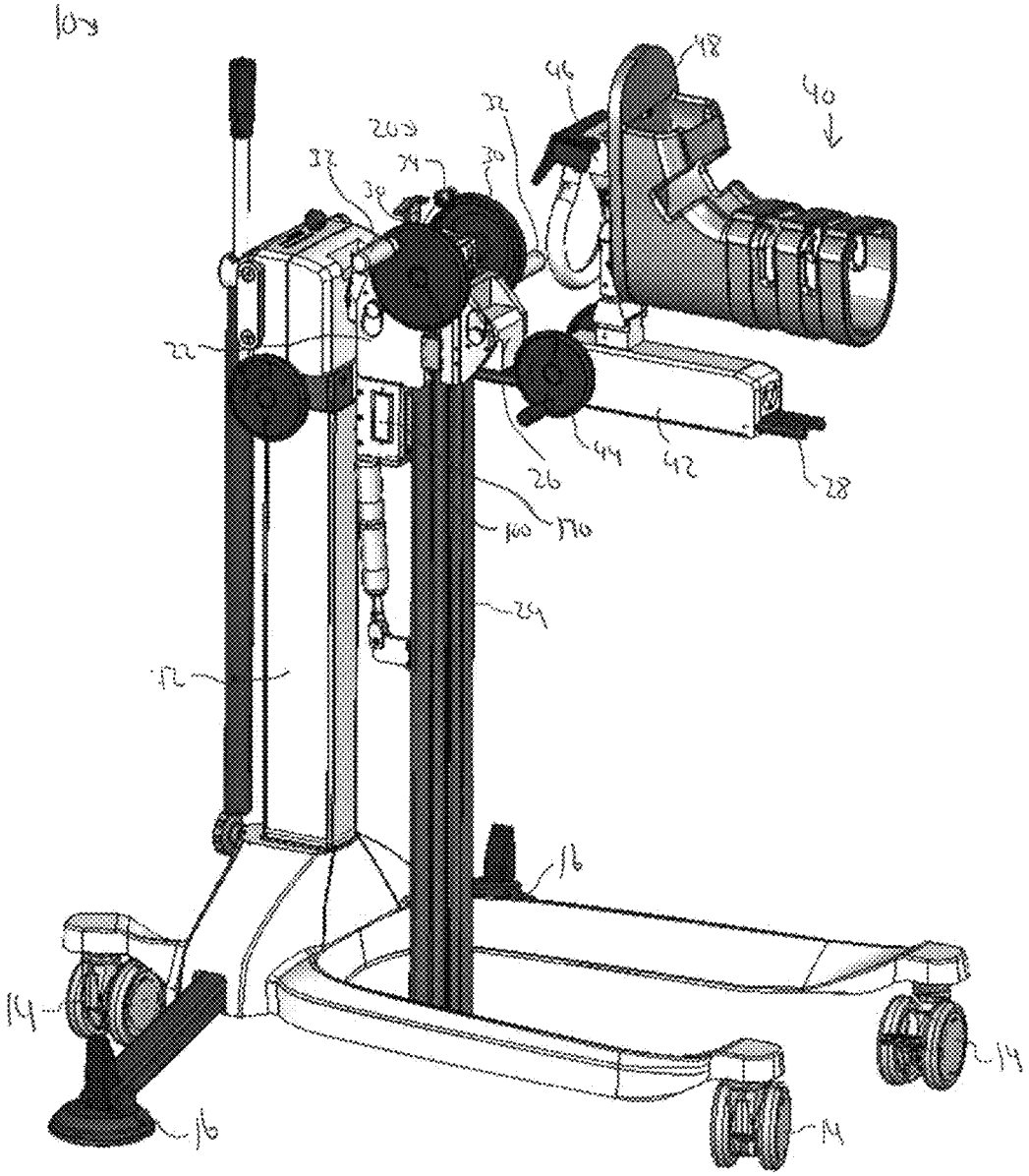
FIG. 1B is a second perspective view of the medical device of FIG. 1A.

Referring now to FIGS. 1A and 1B, an embodiment of a medical device 10 is shown. In this embodiment, medical device 10 is mechanically operated to selectively and controllably hold, support, manipulate, position, and orientation a patient's leg during a surgical or diagnostic procedure. Medical device 10 is provided with a locking device 100 that controllably locks and unlocks device 10—when device 10 unlocked via actuation of locking device 100, device 10 can be used to perform a surgical or diagnostic procedure, however, when device 10 is locked via locking device 100, device 10 cannot be used to perform a surgical or diagnostic procedure. Thus, as will be described in more detail below, device 100 may be described herein as having a "locked" position or configuration and an "unlocked" position or configuration. In this manner, locking device 100 is used to control and limit the usage of device 10. For example, inclusion of locking device 100 on medical device 10 enables the owner or renter of medical device 10 to control and limit the usage of device 10 by another person or entity such as a medical facility that is renting device 10.

In this embodiment, locking device 100 is an electronically actuated and operated device, and thus, may also be referred to herein as electronic locking device 100. As will be described in more detail below, in this embodiment, locking device 100, and hence medical device 10, is unlocked (i.e., transitioned from the locked configuration to the unlocked configuration) via a wireless communication signal to the medical device 10.

Referring still to FIGS. 1A and 1B, in this embodiment, medical device 10 includes a support base 12, a rail assembly 20, a foot support assembly 40, and locking device 100. Support base 12 supports the weight of the medical device 10 and the weight of a patient's appendage, which is coupled to foot support assembly 40. Particularly, support base 12 includes a plurality of wheels 14 allowing for convenient transportation and movement of medical device 10, and a plurality of support pads 16 for releasably affixing medical device 10 to the ground, thereby providing additional support to medical device 10 during the performance of a medical procedure.

Rail assembly 20 provides for positioning and manipulation of the patient's appendage during the performance of a medical procedure. In this embodiment, rail assembly 20 generally includes a support member 22, a first or vertical rail 24, a rail holder 26, a second or horizontal rail 28, and a pair of rotatable cranks 30 with each crank 30 having a handle 32. Support member 22 physically supports rail assembly 20 and foot support assembly 40 and couples rail assembly 20 to support base 12. Vertical rail 24 extends vertically downwards from support member 22 towards the ground. Rail holder 26 is moveably coupled to vertical rail 24 such that rail holder 26 may be displaced along the longitudinal length of vertical rail 24. Particularly, a flexible belt (not shown) is disposed in vertical rail and couples to rail holder 26, where the flexible belt is driven by a sprocket (not shown) coupled with rotatable cranks 30. In this arrangement, rail holder 26 may be displaced along the longitudinal length of vertical rail 24 in response to the rotation of cranks 30 via the interaction between rail holder 26, flexible belt, and accompanying sprocket. Further, the flexible belt frictionally engages vertical rail 24 such that rail holder 26 may occupy various positions along the longitudinal length of vertical rail 24 without a force being applied to cranks 30 by the operator of device 10. In other words, rail holder 26 will remain stationary with respect to vertical rail 24 until cranks 30 are rotated by a practitioner.

An inner end of horizontal rail 28 couples to rail holder 26, and thus, horizontal rail 28 is displaced in conjunction with rail holder 26 along the longitudinal length of vertical rail 24 when cranks 30 are rotated. Horizontal rail 28 is configured to physically support foot support assembly 40, which is moveably coupled thereto. In this embodiment, foot holder assembly 40 generally includes a carriage 42, a pair of cranks 44, a support member 46, and a padded boot 48. Carriage 42 is moveably coupled to horizontal rail 28 and is configured to be displaced along the longitudinal length of horizontal rail 28 in response to the rotation of cranks 44. Particularly, carriage 42 includes a drive assembly (not shown) disposed therein that interfaces with cranks 44 to convert the rotation of cranks 44 into longitudinal motion of carriage 42. Support member 46 physically supports padded boot 48 and couples boot 48 to the carriage 42. In this embodiment, padded boot 48 is pivotally coupled to support member 46, allowing for the pivoting of padded boot 48 during the performance of a medical operation. Padded boot 48 is configured to physically support and releasably couple with a patient's appendage during the performance of a medical operation utilizing medical device 10.

In the manner described, foot holder assembly 40, horizontal rail 28, and rail holder 26 are displaceable (generally up and down in FIGS. 1A and 1B) along the length of vertical rail 24 in response to the rotation of cranks 30. Also, foot holder assembly 40 is displaceable (generally right and left in FIGS. 1A and 1B) along the length of horizontal rail 28 in response to the rotation of cranks 44, and padded boot 48 may be pivoted about a horizontal axis with respect to support member 46.

Figure 1C:
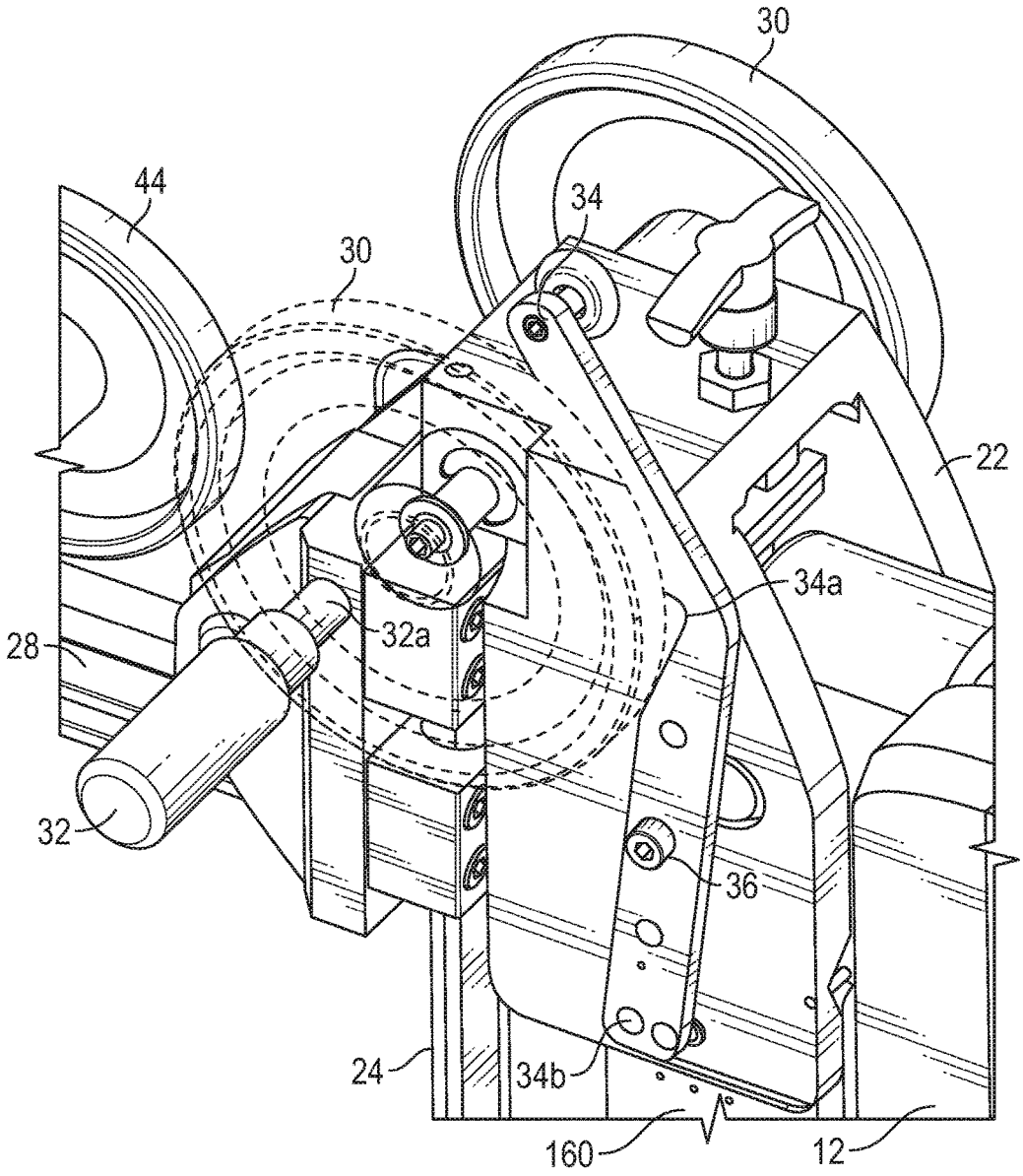
FIG. 1C is an enlarged perspective view of the medical device of FIG. 1A.
Figure 2A:
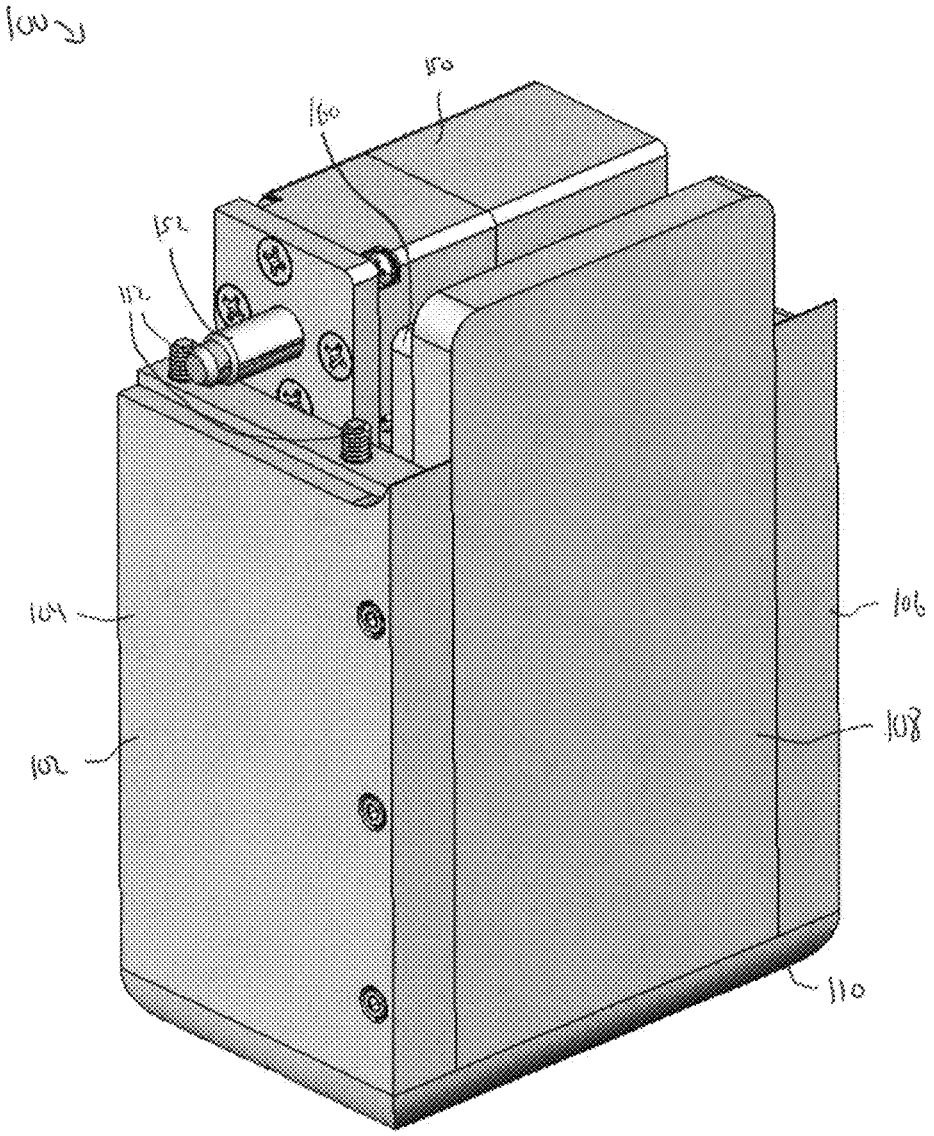
FIG. 2A is a perspective view of the locking device of FIG. 1A.
Figure 2B:
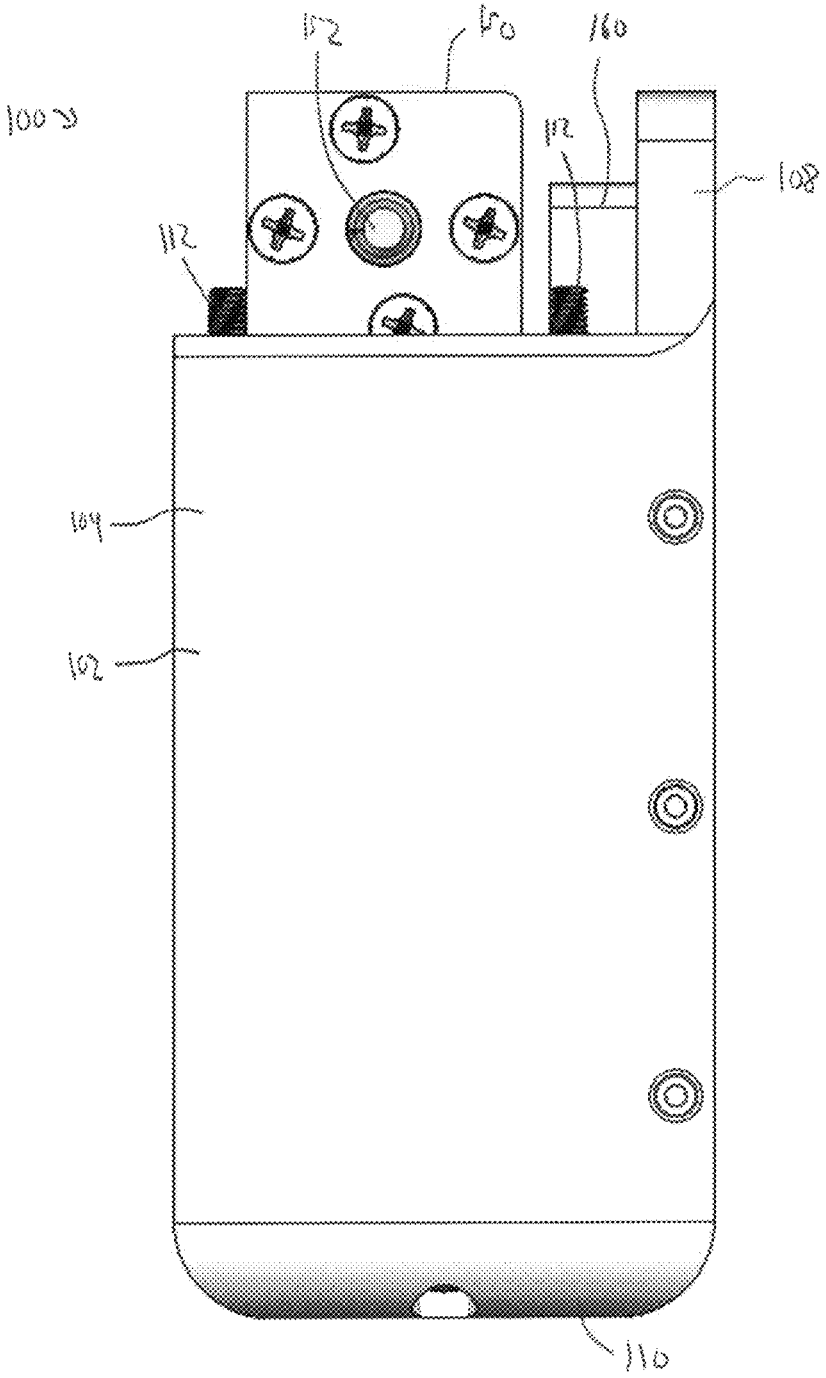
FIG. 2B is a front view of the locking device of FIG. 2A.
Figure 2C:
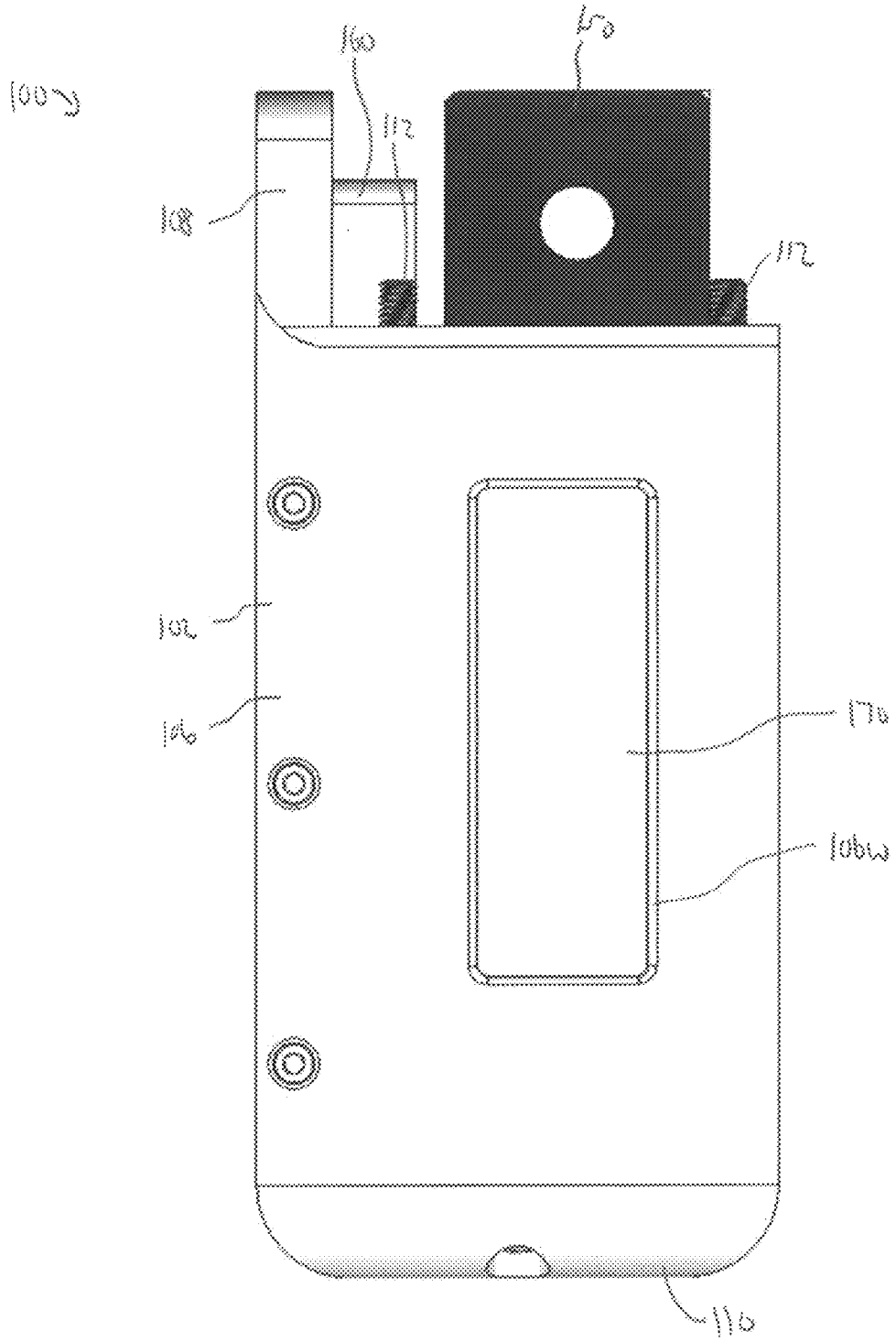
FIG. 2C is a rear view of the locking device of FIG. 2A.
Figure 2D:
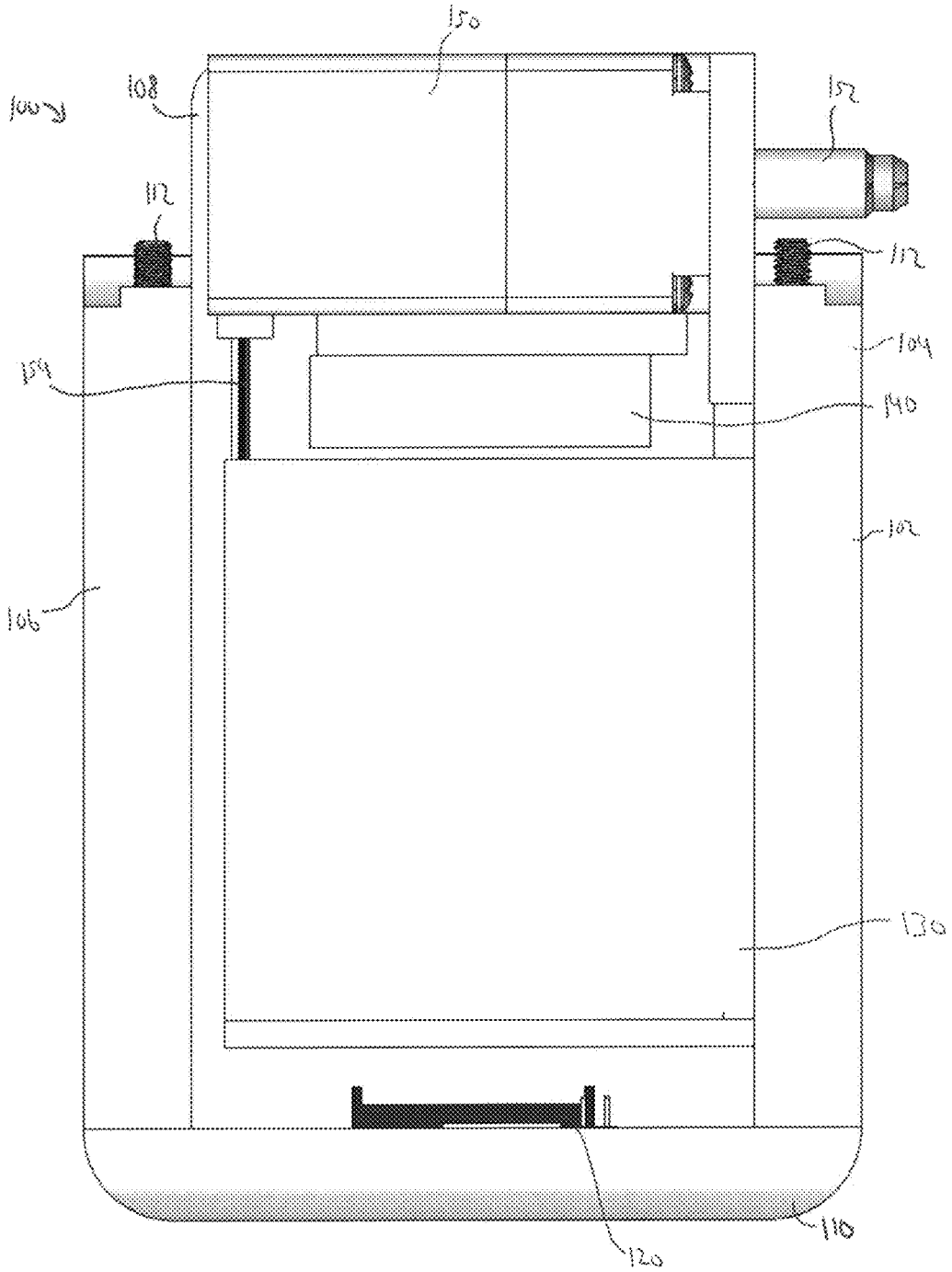
FIG. 2D is a first side view of the locking device of FIG. 2A.
Figure 2E:
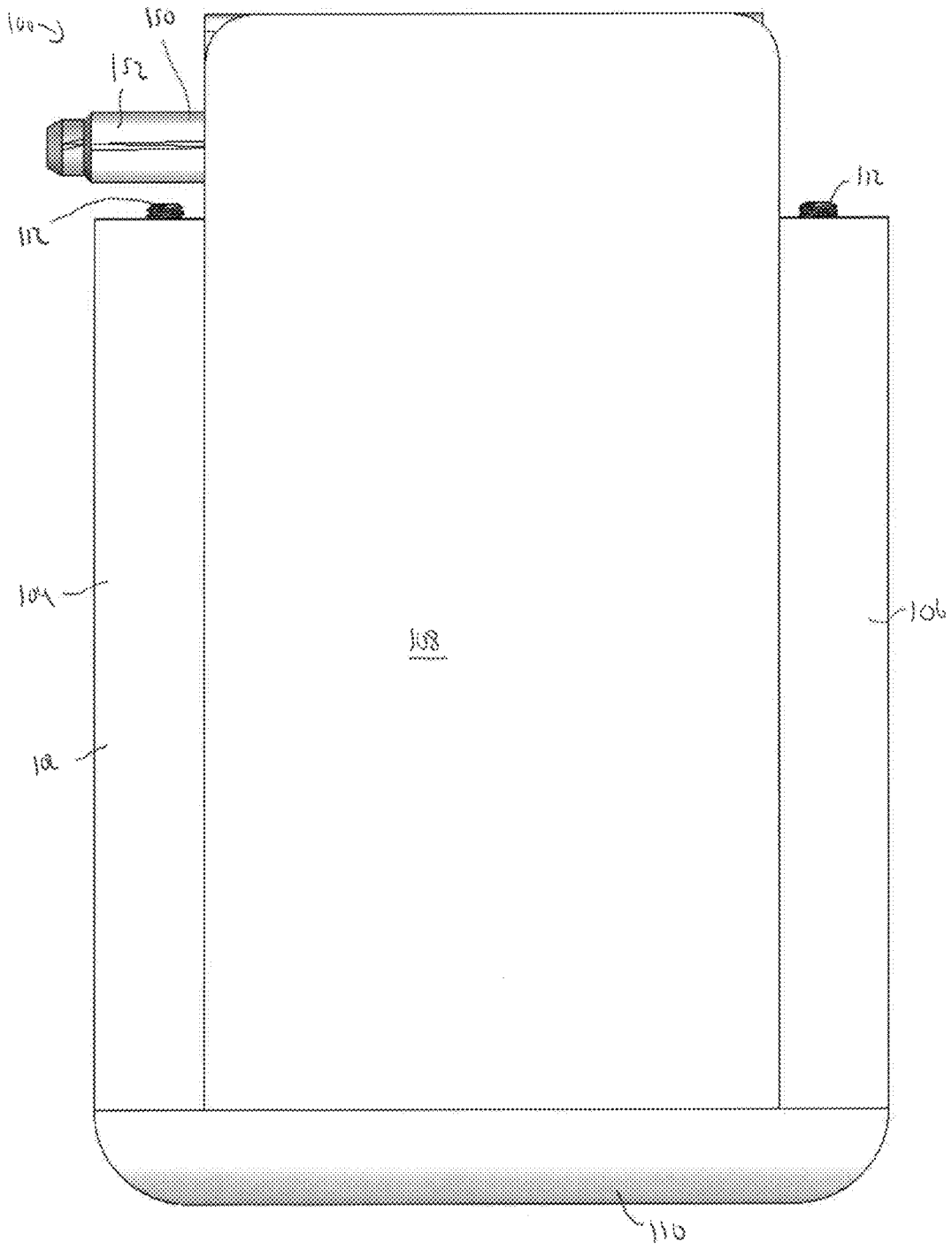
FIG. 2E is a second side view of the locking device of FIG. 2A.
Figure 2F:
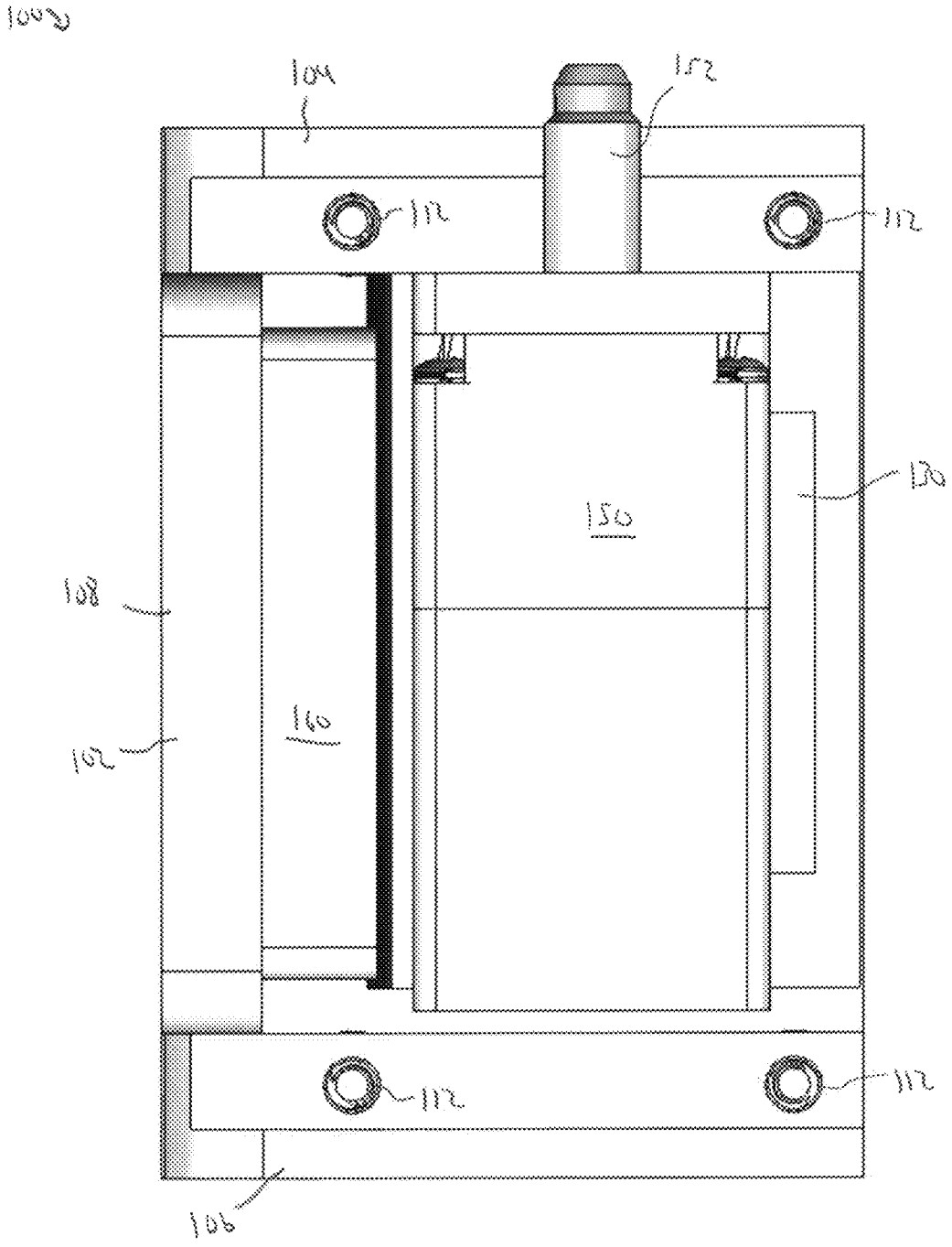
FIG. 2F is a top view of the locking device of FIG. 2A.
Figure 26:
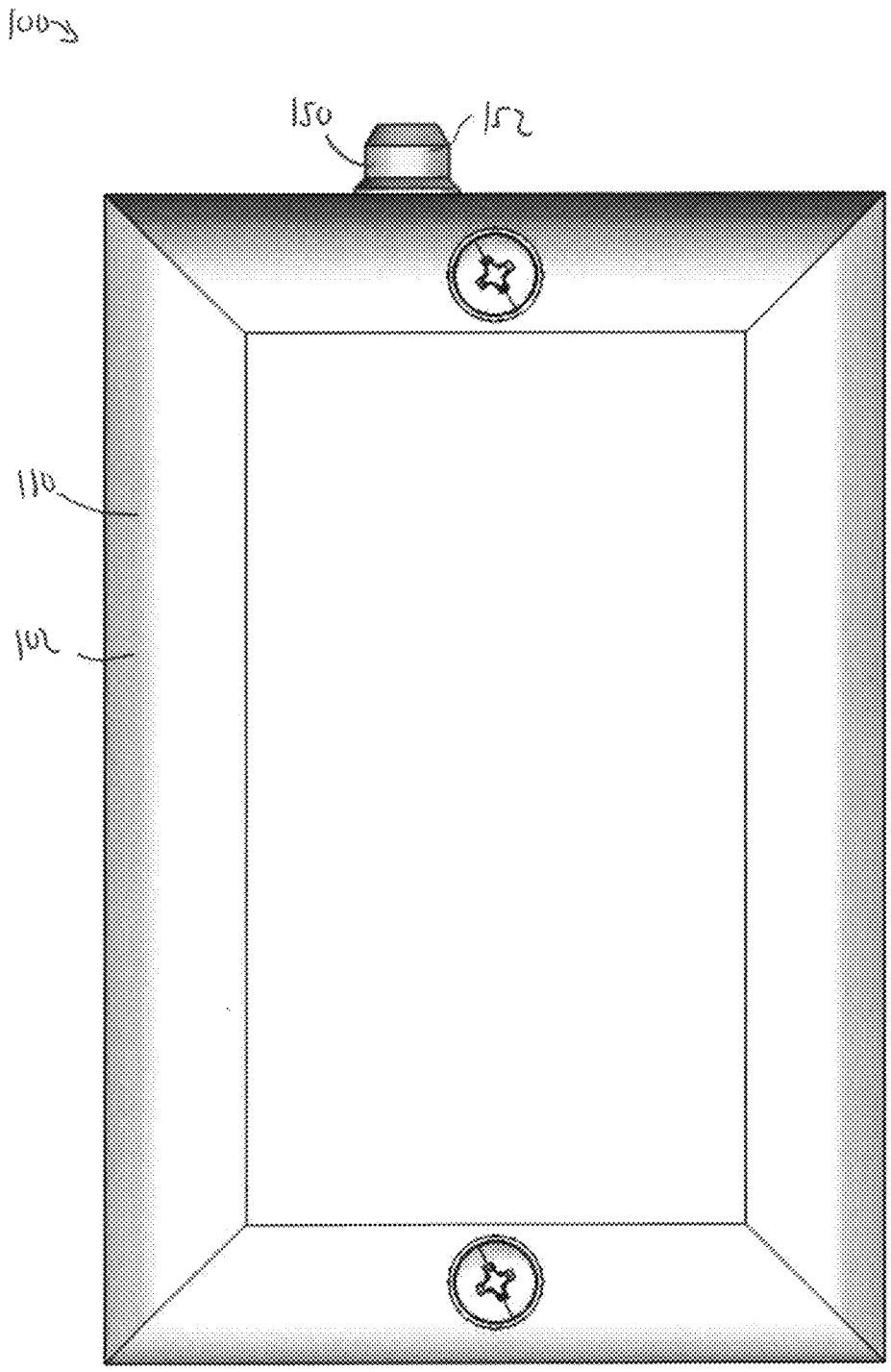
Figure 3A:
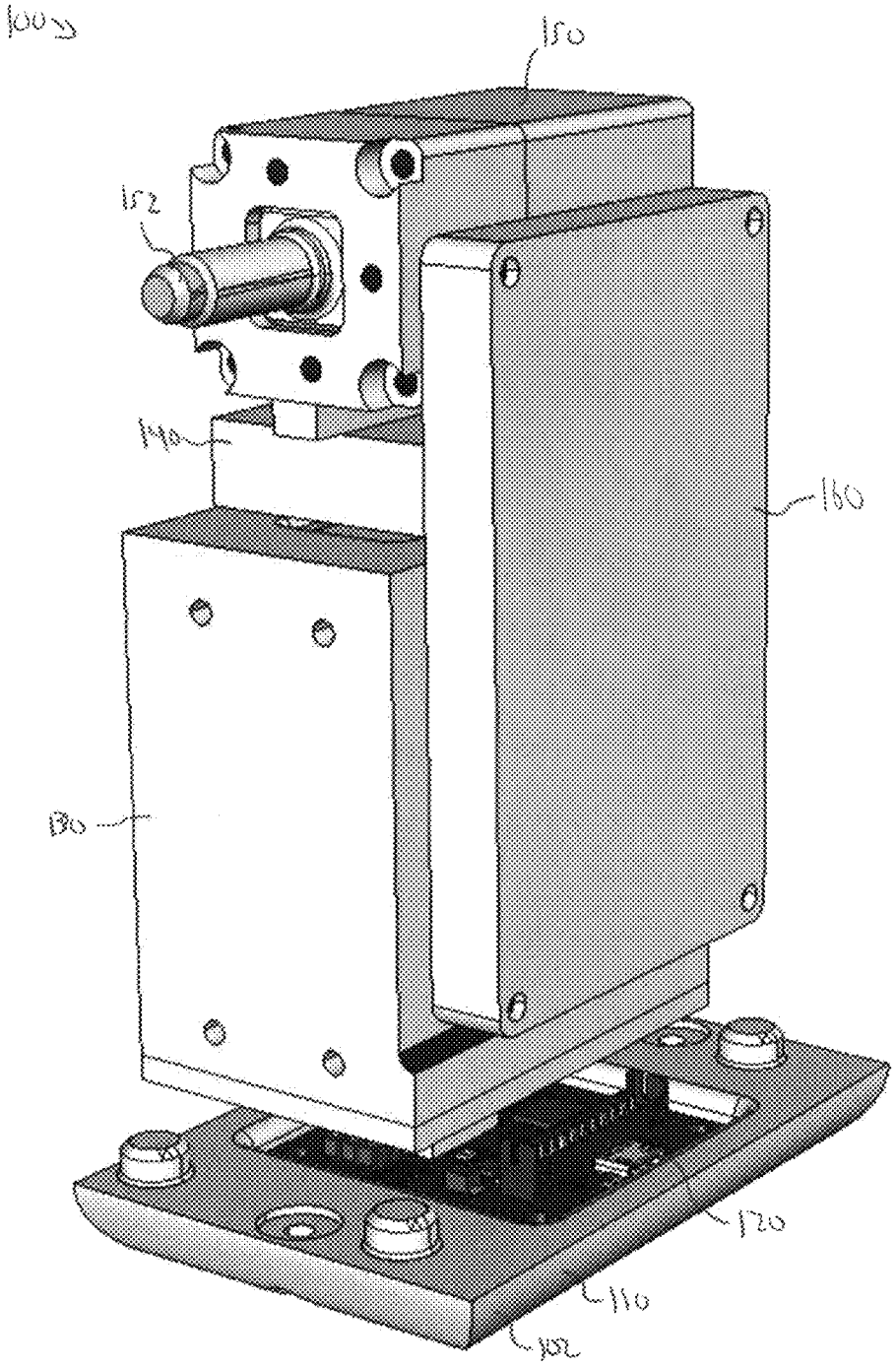
FIG. 3A is a first perspective view of the electronic components within the locking device of FIG. 2A.
Figure 3B:
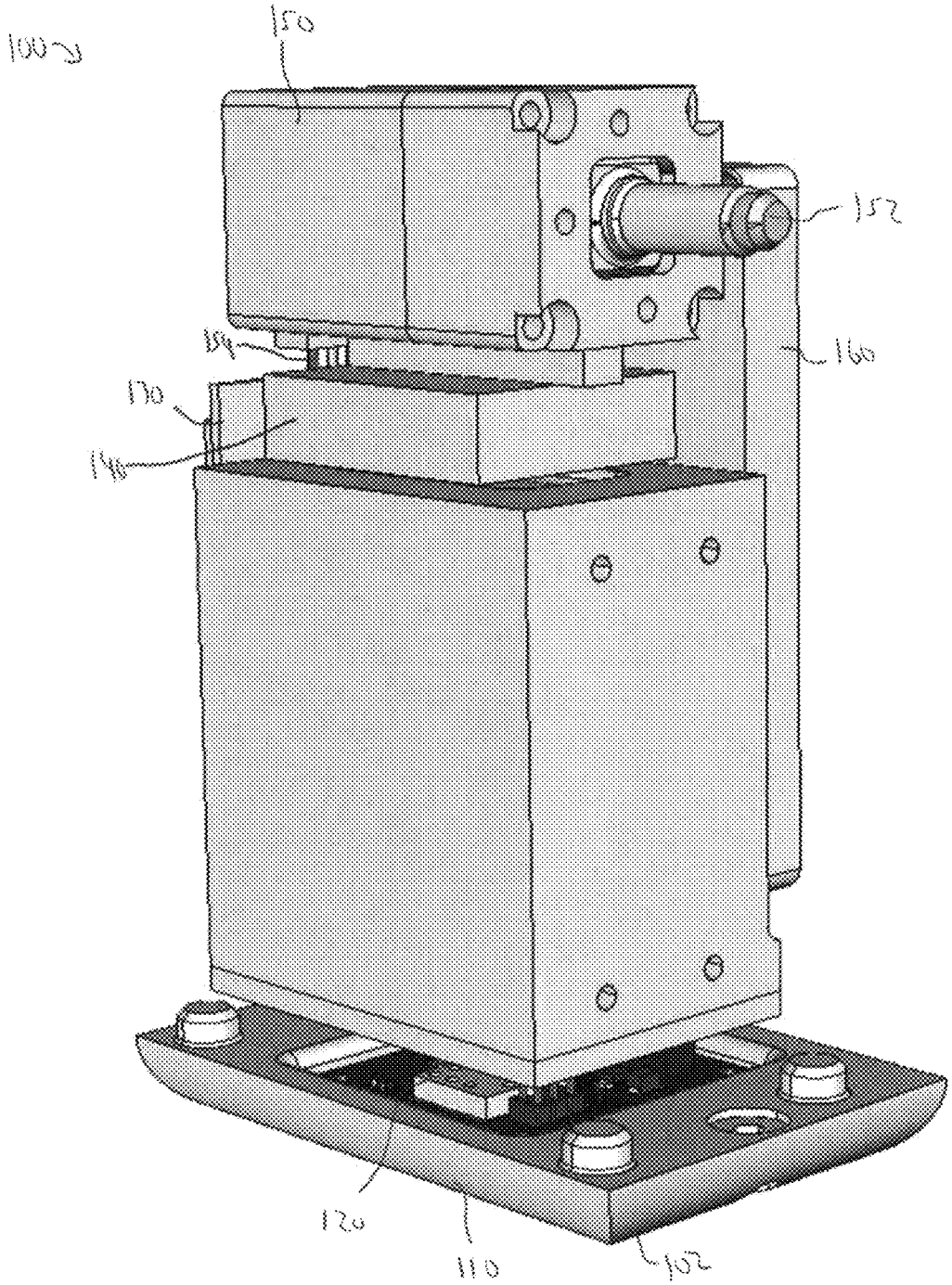
FIG. 3B is a second perspective view of the electronic components within the locking device of FIG. 2A.
Figure 3C:
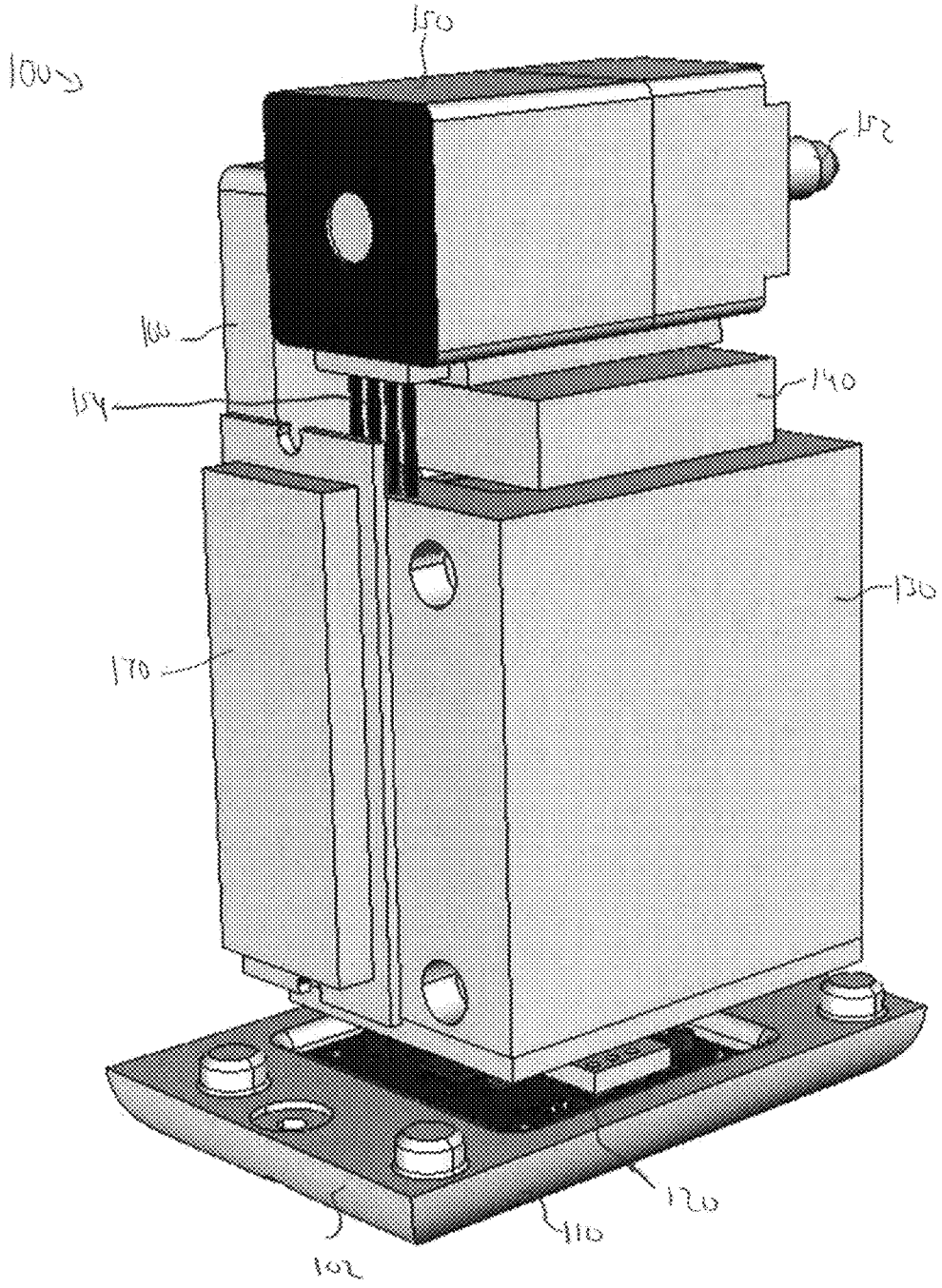
FIG. 3C is a third perspective view of the electronic components within the locking device of FIG. 2A.
Figure 3D:
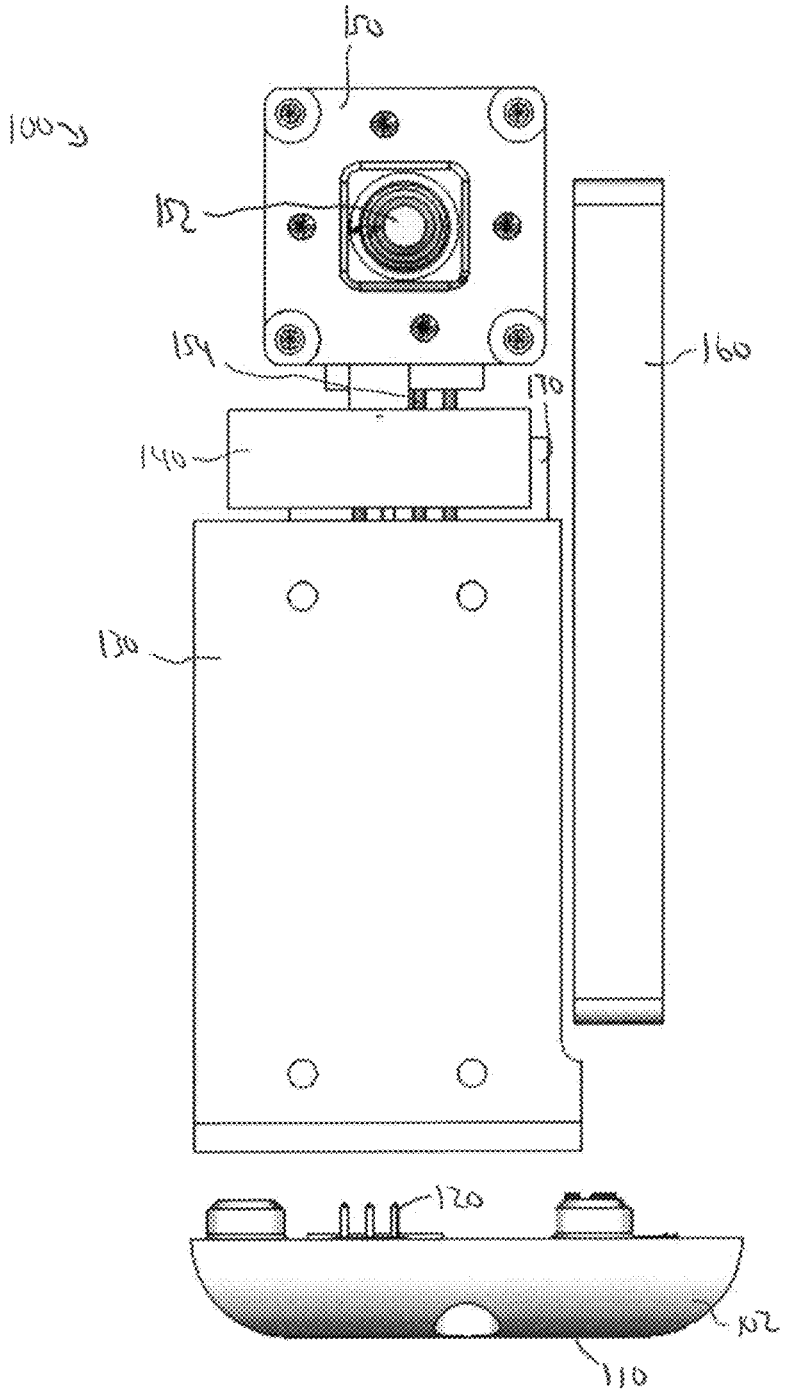
FIG. 3D is a front view of the electronic components within the locking device of FIG. 2A.
Figure 3E:
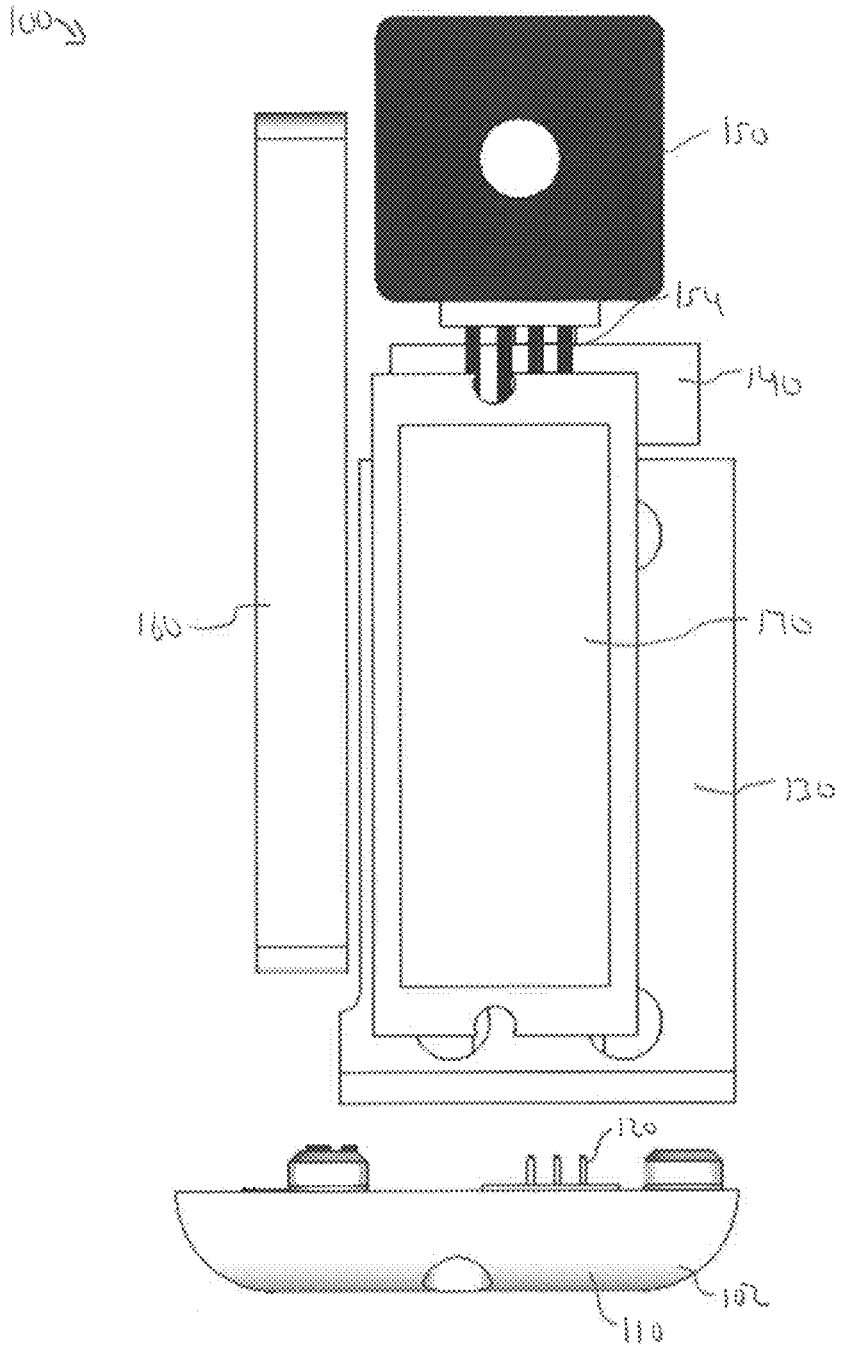
FIG. 3E is a rear view of the electronic components within the locking device of FIG. 2A.

Referring now to FIG. 1C, medical device 10 also includes a locking arm or member 34 pivotally coupled to support member 22 at a pivot point 36. Locking member 34 includes a recess or notch 34*a* between its ends for selectively receiving a locking pin 32*a* extending from the handle 32 of one of the cranks 30. Locking member 34 also includes a generally cylindrical recess or groove 34*b* extending laterally into locking member 34 at its lower end. For purposes of clarity, the crank 30 including locking pin 32*a* is shown as transparent in FIG. 1C.

Locking member 34 can pivot about pivot point 36 between a withdrawn or unlocked position (shown in FIGS. 1A-1C) allowing the free rotation of cranks 30, and an advanced or locked position restricting rotation of cranks 30. In the unlocked position, arm 34 is generally refracted relative to pin 32*a*, thereby allowing pin 32*a* to pass by notch 34*b* as cranks 30 rotate. However, when locking arm 34 is in the locked position, member 34 is advanced toward pin 32*a* and slidingly engages pin 32*a* as cranks 30 rotate. However, as pin 32*a* seeks to pass by locking member 34 during rotation of cranks 30, pin 32*a* is received within and physically engages notch 34*a*, thereby restricting further rotation of crank 30 relative to locking member 34. As shown in FIG. 1C, in this embodiment, locking member 34 pivots in a counterclockwise direction about pivot point 36 to transition from the unlocked position to the locked position pivots in a clockwise direction about pivot point 36 to transition from the locked position to the unlocked position. In this embodiment, locking member 34 is biased to the locked position by a biasing member (e.g., spring).

Referring still to FIG. 1C, electronic locking device 100 is fixably coupled to support member 22. In particular, locking device 100 is mounted in the lower portion of support member 22 and includes a locking pin 152 that is extended and refracted through a hole in support member 22, and is sized to be slidingly received by groove 34*b*. When locking member 34 is in the locked position, locking pin 152 is aligned with groove 34*b*, and thus, locking pin 152 can be extended through support member 22 into groove 34*b*, thereby preventing locking member 34 from pivoting from the locked position to the unlocked position. However, when locking pin 152 is retracted from groove 34*b*, locking member 34 can pivot freely about pivot point 36 between the locked and unlocked positions. Accordingly, locking pin 152 may also be described as having a first, extended, or locked position when locking pin 152 is extended into groove 34*b*, thereby preventing rotation of locking member 34 about pivot point 36 and maintaining locking member 34 in the locked position; and a second, retracted, or unlocked position withdrawn from groove 34*b*, thereby allowing locking member 34 to be rotated freely about pivot point 36 between the locked and unlocked positions. As will be described in more detail below, locking pin 152 is transitioned between the locked and unlocked positions by locking device 100. Accordingly, when pin 152 is in the locked position, device 100 may also be described as being in a locked position, and when pin 152 is in the unlocked position, device 100 may also be described as being in an unlocked position.

In this embodiment, when locking member 34 is in the locked position and locking pin 152 is in the locked position seated in groove 34*b*, the rotation of cranks 30 is limited and/or prevented, and thus, rail holder 26 is restricted and/or prevented from being displaced along vertical rail 24, thereby restricting the ability of the operator of medical device 10 from performing a surgical or diagnostic procedure. However, when locking pin 152 is in the retracted/unlocked position, locking member 34 can be freely transitioned between the locked and unlocked positions, thereby allowing rail holder 26 to be displaced along vertical rail 24.

As described above, in this embodiment, locking member 34 is biased to the locked position. However, when pin 152 is in the retracted/unlocked position, locking member 34 can be pivoted from the locked position to the unlocked position.

Although locking device 100 is configured to selectably lock the pivoting locking member 34 in the locked position, in other embodiments, locking device 100 can be used to restrict other movements of components of a medical device (e.g., medical device 10) to selectably restrict or inhibit a practitioner from using the medical device in a procedure. For instance, locking device 100 could be employed to selectably lock foot support assembly 40 to horizontal rail 28. Further, while in this embodiment locking device 100 is shown and described as a component of medical device 10, it should be appreciated that locking device 100 can be used with other mechanical devices and equipment, including devices that are not used in the medical field.

Referring now to FIGS. 2A-3E, different views of locking device 100 are shown. As previously described, locking device 100 is configured to transition pin 152 between a locked position, restricting use of medical device 10, and an unlocked position, allowing use of the medical device 10 in a medical procedure. In this embodiment, locking device 100 transitions pin 152 from the locked to the unlocked position by reading or interrogating an identification tag with an electromagnetic signal, and then receiving an electromagnetic signal transmitted by the identification tag in response to the interrogation that instructs device 100 to actuate pin 152 to the unlocked position. Accordingly, in this embodiment, locking device 100 comprises a radio-frequency identification (RFID) reader or interrogator configured for use with a passive RFID identification tag forming an active reader passive tag (APRT) system. In other embodiments locking device 100 may employ other types of RFID systems, including active reader active tag (ARAT) and passive reader active tag (PRAT) RFID systems. Also, in other embodiments locking device 100 may utilize other types of readers capable of sending and receiving wireless electromagnetic signals. For instance, in another embodiment the locking device 100 may be a Bluetooth transponder. In other embodiments, electronic locking device 100 may comprise a type of reader configured for sending and receiving electromagnetic signals across a wired connection, such as a Universal Serial Bus (USB) connection.

Referring still to FIGS. 2A-3E, in this embodiment, locking device generally includes a housing 102, a wireless receiver or antenna, 120, a power supply 130, a motor controller 140, a linear motor 150, a processor or integrated circuit (IC) 160, and a digital display 170. Housing 102 physically protects and shields the electronic components of locking device 100. In this embodiment, housing 102 is a box including a front member 104, a rear member 106, a side member 108 coupled between front member 104 and rear member 106, and a bottom member or antenna housing 110 coupled to front member 104, rear member 106, and side member 108. Housing 102 also includes a pair of fasteners 112 for coupling electronic locking member 100 to medical device 10.

Power supply 130 of electronic locking device 100 is configured to provide electrical power to the antenna 120, motor controller 140, linear motor 150, IC 160, and digital display 170. In an embodiment, power supply 130 comprises a rechargeable battery. Antenna 120 is electrically coupled with power supply 130 and IC 160, and is physically received within antenna housing 110. Antenna 120 is configured to wirelessly transmit and receive signals and power from other devices, including identification tags, as will be explained further herein. IC 160 is disposed between power supply 130 and side member 108 of housing 102 and is configured to send and receive signals from the antenna 120, and to transmit signals to the motor controller 140 and/or digital display 170. IC 160 is electrically coupled with antenna 120, power supply 130, motor controller 140, and digital display 170. In this embodiment, IC 160 comprises a processor for processing received signals and a memory for storing instructions and signals received from antenna 120. Particularly, IC 160 is configured to transmit signals to the motor controller 140 for actuating the linear motor 150, and to transmit signals to digital display 170 for displaying information relating to the operation of electronic locking device 100, as will be discussed further herein. Motor controller 140 is electrically coupled with power supply 130 and IC 160, and is configured to receive signals from IC 160, and transmit electrical signals to linear motor 150 for actuating linear motor 150.

Linear motor 150 of electronic locking device 100 is electrically coupled to power supply 130 via wires 154 and motor controller 140, and is configured to convert electrical power received from power supply 160 into linear motion of the locking pin 152, such that locking pin 152 may be actuated or displaced between the extended/locked position and the retracted/unlocked position as previously described. In this embodiment, linear motor 150 includes a retract feature, wherein when locking pin 152 is impeded from actuating to the extended position due to an obstruction (e.g., locking member 34 is not in the locked position with groove 34*b* aligned with pin 152), locking pin 152 will automatically retract back to the refracted position to protect locking pin 152 and linear motor 150 from damage. Particularly, the linear motor 150 is configured to retract locking pin 152 if a threshold force is "felt" upon locking pin 152, and the locking process is repeated until electronic locking device 100 successfully locks with locking pin 152 disposed in the extended position. The actuation of linear motor 150 and locking pin 152 is controlled by motor controller 140, where motor controller 140 transmits signals to linear motor 150 and receives signals from IC 160. Digital display 170 is electrically coupled to power supply 130 and IC 160, and is configured to receive signals from the IC 108 and display the received signals digitally, such that they may be read by a user of electronic locking device 100. In this embodiment, digital display 170 is disposed in a window 106*w* extending through rear member 106 of housing 102.

Figure 4:
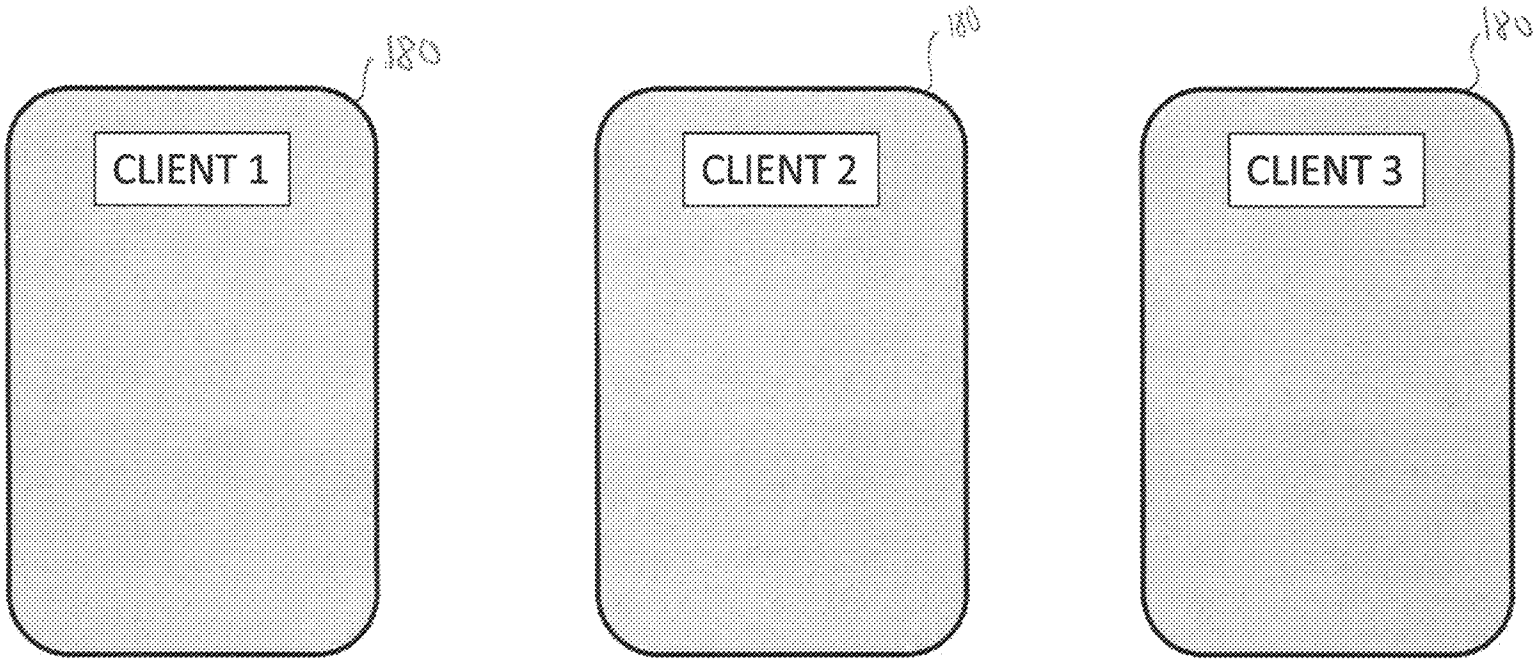
FIG. 4 is a front view of a plurality of identification tags for use with the locking device of FIG. 2A.

Referring now to FIG. 4, a plurality of identification tags 180 is shown. Identification tags 180 are configured to wirelessly communicate with, and transmit information to, the locking device 100. In this embodiment, identification tags 180 each include a processor, memory, and antenna (not shown), where the identification tag 180's antenna is configured to receive wireless signals from the antenna 120 of locking device 100, and to transmit the received signal to the processor of the identification tag 180. Since in this embodiment locking device 100 is an APRT-type RFID system, the processor of each identification tag 180 is powered by signals transmitted from the antenna 120 of electronic locking device 100. However, as discussed above, in other embodiments, locking device 100 may comprise other forms of wireless readers, and thus, in other embodiments identification tags 180 may comprise other forms of wireless transmitters. Moreover, in other embodiments, locking device 100 may communicative via a wired connection with an electronic device. In these embodiments, the functionality provided by identification tags 180 may be provided by another electronic component capable of forming a wired electronic connection with electronic locking device 100. In order to communicate with IC 160 of electronic locking device 100, the processor of each identification tag 180 includes data identifying the particular identification tag 180 and other data relating to the actuation of linear motor 150.

In this embodiment, locking device 100 transitions pin 152 from the locked position to the unlocked position by placing an identification card 180 proximal the antenna 120 of electronic locking device 100. By placing the card 180 proximal antenna 120, an unlocking signal is transmitted from IC 160 of electronic locking device 100 to the processor of card 180 via wireless antenna 110. In response to receiving a signal from the IC 160 of locking device 100, an unlocking signal including an unlocked duration period data signal (e.g., 60 minutes) is transmitted to the IC 160 via the antenna of the card 180. The unlocking signal identifies the identification card 180 and includes unlocked duration period, instructing the IC 160 to maintain pin 152 in the unlock position for a predetermined period of time, and then transition pin 152 to the locked position after expiration of the predetermined period of time. In another embodiment, the unlocked duration period may be programmed directly into the IC 160. Thus, upon receiving the unlocking signal from the tag 180, the IC 160 actuates the linear motor 150 to displace the locking pin 152 from the extended position to the retracted position to unlock locking member 34 of medical device 10.

During this process, the IC 160 of electronic locking device 100 also communicates a signal to the digital display 170 to display a message visually indicating the unlocking of the locking device 100, or in other words, the displacement of locking pin 152 from the extended position to the retracted position. In an embodiment, the digital display 170 also visually indicates the time remaining of the unlocked duration period. Once the electronic locking device 100 has been unlocked, a timer included in the IC 160 counts down the unlocked duration period provided by either the processor of the identification tag 180. For instance, in one embodiment the unlocked duration period is programmed into the identification tag 180, while in another embodiment the unlocked duration period is programmed into the IC 160 of electronic locking device 100. The remaining duration of time left of the unlocked duration period is visually displaced on the digital display 170 via the IC 160. After the unlocked duration period has expired, the IC 160 actuates linear motor 150 to displace locking pin 152 from the retracted position to the extended position, thereby placing electronic locking device 100 back into the locked configuration. If, after the unlocked duration period has expired, the groove 34*b* of locking member 34 is misaligned with locking pin 152, the locking pin 152 will contact the surface of locking member 34 and immediately retract, as instructed by motor controller 140, back into the unlocked position for a brief predetermined period of time (e.g., 1-5 seconds). Following the brief period of time in the unlocked position, the locking pin 152 will again be displaced by linear motor 150 towards the locked position. If groove 34 of locking member 34 is still misaligned with locking pin 152, then locking pin 152 will again retract into the unlocked position, as described above. The above process will be repeated until groove 34*b* of locking member 34 aligns with locking pin 152, allowing locking pin 152 to be actuated into the locked position.

The predetermined unlocked duration period is selected to provide a practitioner with more than sufficient time to perform a single medical procedure using medical device 10, but insufficient time to perform more than one medical procedure using medical device 10. In other words, the unlocked duration period is configured to allow a practitioner to perform a single medical procedure employing medical device 10 before electronic locking device 100 reenters the locked position with locking pin 152 disposed in the extended position. In other embodiments, the unlocked duration period may be configured to allow a practitioner to perform more than one medical procedure employing medical device 10 before electronic locking device 100 reenters the locked position. In still other embodiments, the unlocked duration period may be configured for other periods of time unrelated to the time required to perform a medical procedure employing medical device 10. For example, the unlocked duration period may be set for a fixed interval of time, such as one week, one month, etc.

In the embodiment described above, the identification card 180 includes unlocked duration period data prescribing the duration of time electronic locking device 100 is to remained unlocked following the scanning or reading of the identification tag 180 by the electronic locking device 100. in other embodiments, the processor of the identification tag 180 may also include a programmable counter including initial count data prescribing a predetermined number of "uses" or "unlocks" of medical device 10, whereby each time the electronic locking device 100 is unlocked by the unlocking signal transmitted from the identification tag 180, the IC 160 instructs the processor of the identification tag 180 to reduce the overall count (e.g., the remaining number of uses or unlocks) of the counter by one. For instance, a practitioner of locked medical device 10 may purchase an identification tag 180 including a predetermined number of "unlocks" or uses such that the identification tag 180 may only be used to unlock the electronic locking device 100 the predetermined number of times programmed into the identification tag 180. As described above, each time the identification tag 180 is used to unlock medical device 10, the identification tag 180 will transmit to the electronic locking device 100 unlocked period duration data, stored on identification tag 180, prescribing the duration of time electronic locking device 100 is to remain unlocked. Once the predetermined number of times of unlocks have been used, the unlocking signal transmitted to the electronic locking device 100 from the identification tag 180 will no longer unlock the electronic locking device 100. In this way, a practitioner may rent a medical device 10 for a predetermined number of medical procedures employing the medical device 10, with the electronic locking device 100 and identification tag 180 used to ensure that electronic locking device 10 may only be used for the number of procedures purchased by the practitioner.

Figure 5A:
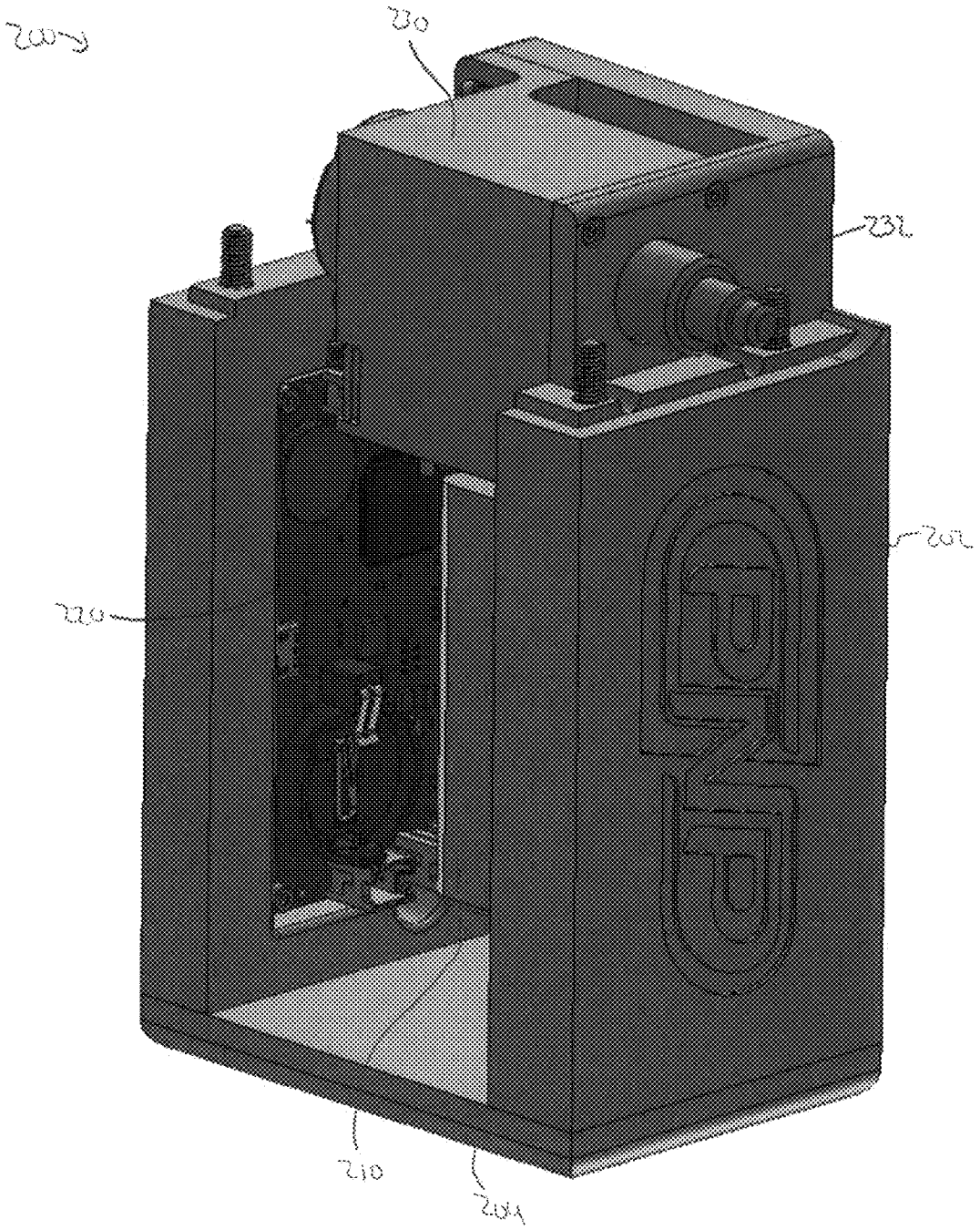
FIG. 5A is a first perspective view of an embodiment of a locking device in accordance with principles disclosed herein.
Figure 5B:
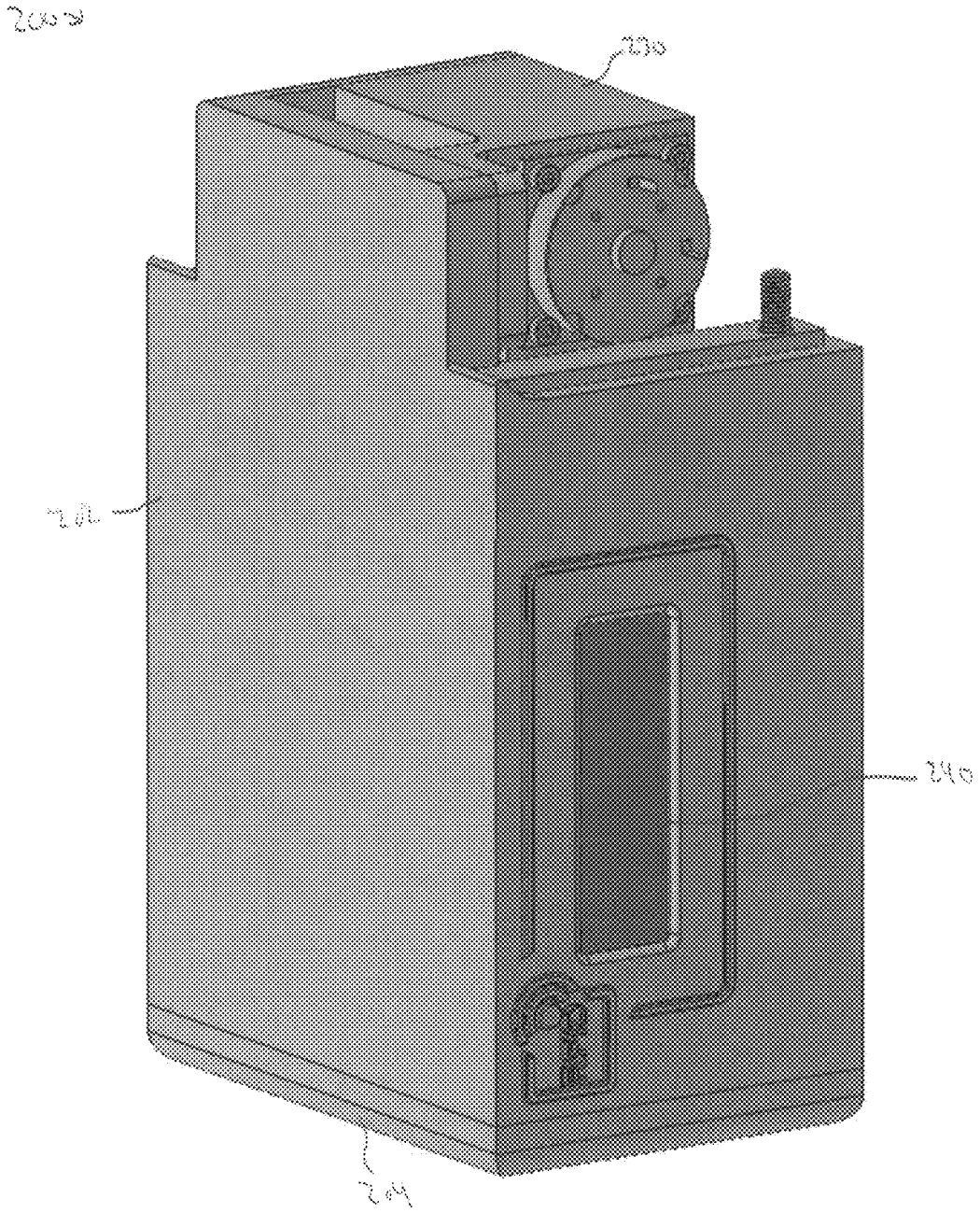
FIG. 5B is a second perspective view of the locking device of FIG. 5A.

Referring to FIGS. 5A and 5B, another embodiment of an electronic locking device 200 is shown. Electronic locking device 200 is configured for use with identification tags 180 for selectably locking and unlocking medical device 10. In this embodiment, electronic locking device 200 generally includes a housing 202, a wireless receiver or antenna housing 204, a power supply 210, an IC 220, a linear motor 230 having a locking pin 232, and a digital display 240. Power supply 210 is configured to supply electrical power to the antenna (not shown), IC 22, linear motor 230, and digital display 240. The antenna (not shown) is configured to receive unlocking signals from, and send signals to identification tag 180, including signals from identification tag 180 including unlocked duration period data and initial use count data. IC 220 comprises a processor and a memory for processing and storing signals received from the antenna. As with linear motor 150, linear motor 230 is configured to displace locking pin 232 between a locked or extended position and a refracted or unlocked position, thereby actuating electronic locking device 200 between a locked position and an unlocked position, respectively, in response to a signal sent from the IC 220. Digital display 240 is configured to visually display signals transmitted to the electronic locking device 200 from the identification tag 180, including unlocked duration period data and/or initial use count data.

Figure 6:
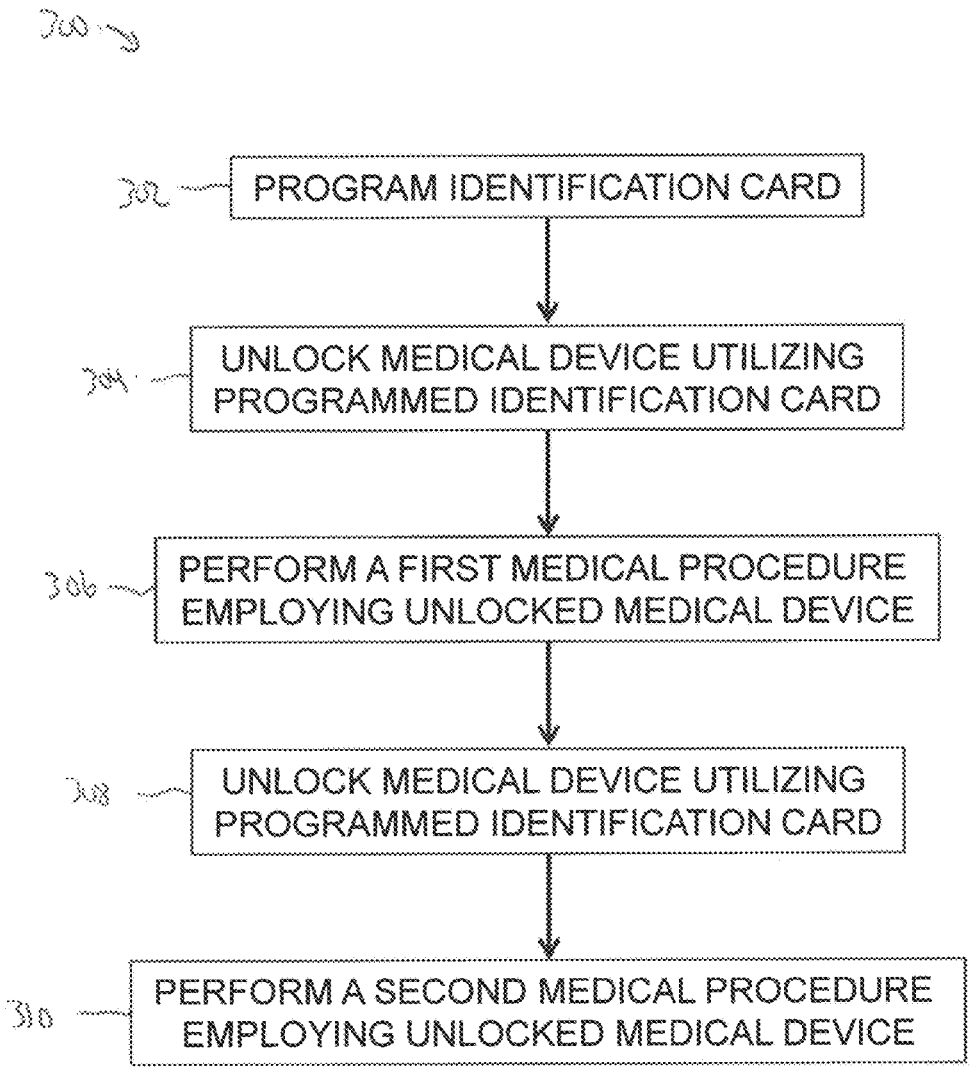
FIG. 6 is a flowchart illustrating an embodiment of a method for employing the locking device of FIG. 2A or 5A unlocking a medical device for performing one or more medical procedures in accordance with principles disclosed herein.

Referring now to FIG. 6, an embodiment of a method 300 for using locking device 100 to control and limit use of a medical device is shown. For purposes of clarity and further explanation, use of locking device 100 will be described within the context of medical device 10 previously described. However, in general, locking device 100 can be used to control and limit the use of other medical devices or non-medical devices.

Starting at block 302, an identification card 180 is programmed for unlocking medical device 10 (i.e., transitioning pin 152 of locking device 100 from the locked to the unlocked position). In one embodiment, programming the identification card comprises programming a predetermined unlocked duration period data onto the card 180 so that the card 180 can be used to unlock device 10 for the predetermined period of time. In another embodiment, programming the identification card comprises programming an initial use count data onto the identification card, where the identification card may be used to unlock the medical device 10 for the predetermined number of uses as defined by the use count data.

Moving now to block 304, the programmed identification card 180 is used to unlock medical device 10. In particular, identification card 180 is placed adjacent antenna 120 of locking device 100 of medical device 10 to wirelessly transmit signals from the identification card 180 to the antenna 120 of the locking device 100. The transmitted signals are subsequently transmitted or communicated from antenna 120 to IC 160 of locking device 100. In general, the wireless transmission of signals from identification card 180 to antenna 120 may comprise transmitting the unlocked duration period data and/or initial count data stored on the programmed identification 180 to the antenna 120 of locking device 100. Upon receipt of the transmitted signals, locking device 100 transitions pin 152 from the locked position to the unlocked position. More specifically, once the signal from identification card 180 is been transmitted to antenna 120 and communicated to IC 160, the IC 160 instructs motor controller 140 to actuate linear motor 150, thereby displacing locking pin 152 from the extended/locked position to the retracted/unlocked position. Once pin 152 is in the unlocked position, locking member 34 of medical device 10 is free to rotate from the locked position to the unlocked position, thereby enabling free use of device 10. Further, the IC 160 also communicates a signal to the digital display 170 visually displaying the unlocked duration period data transmitted to locking device 100 from the programmed identification card 180. In an embodiment, the IC 160 may also communicate a signal to the digital display 1700 to visually display the initial count data, including the number of "unlocks" remaining on the identification card 180 following the latest unlocking of electronic locking device 100.

Next, at block 306, once pin 152 is in the unlocked position, a first medical procedure is performed with medical device 10. For example, following the unlocking of locking device 100, medical device 10 is employed to perform a medical procedure during which the unlocked duration period data is visually displaced on the digital display 170 of electronic locking device 100. In this embodiment, the unlocked duration period is sufficient to allow for the performance of a single medical procedure employing medical device 10 before the unlocked duration period reaches zero. Once the unlocked duration period expires or reaches zero, the IC 160 sends a signal to motor controller 140 to actuate the linear motor 150 and displace locking pin 152 from the retracted position to the extended position to lock the medical device 10. If, after the unlocked duration period has expired, the groove **34*b* of locking member 34 is misaligned with locking pin 152, the locking pin 152 will contact the surface of locking member 34 and immediately retract, as instructed by motor controller 140, back into the unlocked position for a brief period of time (e.g., 1-5 seconds). Following the brief period of time in the unlocked position, the locking pin 152 will again be displaced by linear motor 150 towards the locked position. If groove 34 of locking member 34 is still misaligned with locking pin 152, then locking pin 152 will again retract into the unlocked position, as described above. The above process will be repeated until groove 34*b* of locking member 34 aligns with locking pin 152, allowing locking pin 152** to be actuated into the locked position.

The activities illustrated at blocks 308 and 310 are optional with respect to the method 300. Particularly, the activities illustrated at blocks 308 and 310 relate to an embodiment where the identification card 180 is initially programmed with initial count data at block 302, and the initial count data is transmitted to the electronic locking device at block 304. At block 308 the medical device 10 is unlocked using the programmed identification card 180 for a second time. For example, an initial count data of "2" may be transmitted to an identification card 180 at block 302, with the initial count being reduced to "1" following the transition of locking device 100 from the locked position to the unlocked position at block 304, thereby leaving one count to perform a second unlocking of locking device 100 and medical device 10 at block 308. As described above, each time the identification tag 180 is used to unlock medical device 10, the identification tag 180 will transmit to the electronic locking device 100 unlocked period duration data, stored on identification tag 180, prescribing the duration of time electronic locking device 100 is to remain unlocked. Following the second unlocking of locking device at block 308, the initial count data is reduced to "0", prohibiting the identification card 180 from being used to unlock medical device 10 for a third time unless the identification card 180 is reprogrammed, similar to the programming performed at block 302, to include one or more counts on the initial count data stored on the identification card 180.

Block 310 illustrates the performance of a second medical procedure employing the medical device 10 which has been unlocked for a second time using the programmed identification card 180. As with block 306, at block 308 the medical device 10 will remain unlocked until the unlocked duration period reaches zero, at which point the electronic locking device 100 will actuate to the locked position, locking medical device 10. In this embodiment, the unlocked duration period transmitted to the electronic locking device 100 at block 308 is for the same period of time as the duration period data transmitted to the electronic locking device 100 at block 304.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the exemplary embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An electronic locking device for selectively locking a medical device, comprising:

an antenna configured to wirelessly receive information from an identification tag, wherein the identification tag comprises unlocked duration period data;

a motor coupled to the antenna; and a locking pin coupled to the motor;

wherein the motor is configured to simultaneously withdraw the locking pin from a locked position to an unlocked position spaced from the locked position and allow usage of the medical device for a predetermined period of time prescribed by the unlocked duration period data in response to an unlocking signal received by the antenna from the identification tag, wherein the locking pin is configured to prevent usage of the medical device in the locked position.

2. The electronic locking device of claim 1, wherein the identification tag comprises initial count data prescribing the number of times the identification tag can instruct the electronic locking device to move the locking pin from the locked position to the unlocked position in response to the unlocking signal from the identification tag.

3. The electronic locking device of claim 1, further comprising a digital display coupled to an integrated circuit, wherein the digital display is configured to visually indicate the unlocked duration period data.

4. The electronic locking device of claim 3, wherein the digital display is configured to visually indicate initial count data prescribing the number of times the identification tag can instruct the electronic locking device to move the locking pin from the locked position to the unlocked position in response to the unlocking signal from the identification tag.

5. The electronic locking device of claim 1, wherein the identification tag comprises a passive radio-frequency identification tag.

6. The medical device of claim 1, wherein the motor is configured to retract the locking pin into the unlocked position in response to the locking pin engaging an obstruction while moving towards the locked position from the unlocked position.

7. A medical device for performing a surgical or diagnostic procedure on a patient, the medical device comprising:

a base;

a locking member moveably coupled to the base; and an electronic locking device coupled to the base, the electronic locking device comprising:

an antenna configured to wirelessly receive information from an identification tag, wherein the identification tag comprises unlocked duration period data;

a motor coupled to the antenna; and a locking pin coupled to the motor;

wherein the motor is configured to simultaneously withdraw the locking pin from a first position to a second position spaced from the first position and allow usage of the medical device for a predetermined period of time prescribed by the unlocked duration period data in response to an unlocking signal received by the antenna from the identification tag, wherein the locking pin is configured to restrict relative movement between the locking member and the base in the first position and allow relative movement between the locking member and the base in the second position.

8. The medical device of claim 7, wherein the identification tag comprises initial count data prescribing the number of times the identification tag can instruct the electronic locking device to move the locking pin from the first position to the second position in response to the unlocking signal from the identification tag.

9. The medical device of claim 7, wherein the locking member is pivotally coupled to the base, and comprises a locked position configured to prevent usage of the medical device and an unlocked position configured to allow usage of the medical device.

10. The medical device of claim 9, wherein, when the locking pin is in the first position, the locking pin is configured to lock the locking member in the locked position.

11. The medical device of claim 9, wherein, when the locking pin is in the first position and the locking member is in the locked position, the locking pin is received in a groove of the locking member.

12. The medical device of claim 9, wherein, when the locking member is in the locked position, the locking member is configured to restrict the rotation of a crank coupled to the base.

13. The medical device of claim 9, wherein the motor is configured to retract the locking pin into the second position in response to the locking pin engaging an obstruction while moving towards the first position from the second position.

14. The medical device of claim 13, wherein the motor is configured to extend the locking pin towards the first position following a predetermined period of time after the retraction of the locking pin into the second position.

15. A method for controllably locking a medical device using an electronic locking device, comprising:

preventing use of the medical device with the electronic locking device coupled to the medical device;

wirelessly communicating an unlocking signal from an identification tag to the electronic locking device coupled to the medical device;

wirelessly communicating unlocked duration period data from the identification tag to the electronic locking device;

actuating a motor of the electronic locking device to simultaneously withdraw a locking pin from a locked position to an unlocked position spaced from the locked position and allow usage of the medical device in response to receiving the unlocking signal from the identification tag; and actuating the motor to advance the locking pin from the unlocked position to the locked position to prevent use of the medical device after a predetermined period of time prescribed by the unlocked duration period data.

16. The method of claim 15, further comprising programming the identification tag with unlocked duration period data.

17. The method of claim 15, wherein communicating information from the identification tag to the electronic locking device comprises wirelessly transmitting a radio-frequency identification signal from the identification tag to the electronic locking device.

18. The method of claim 16, further comprising wirelessly communicating to the electronic locking device from the identification tag initial count data prescribing the number of times the identification tag can communicate the unlocking signal to the electronic locking device to unlock the electronic locking device.

19. The method of claim 15, further comprising visually displaying the unlocked duration period data on a digital display of the electronic locking device.

20. The method of claim 15, wherein unlocking the electronic locking device in response to receiving the unlocking signal from the identification tag comprises allowing a locking member coupled to a base of the medical device to move relative to the base.

21. The electronic locking device of claim 1, wherein the electronic locking device is mounted to the medical device.

* * * * *